US007854832B2

(12) United States Patent
Komatsu et al.

(10) Patent No.: US 7,854,832 B2
(45) Date of Patent: Dec. 21, 2010

(54) SIGNAL PROCESSING DEVICE AND CONTROL UNIT

(75) Inventors: Kazuhiro Komatsu, Hyogo (JP); Keisuke Kido, Hyogo (JP); Kouji Oonishi, Hyogo (JP)

(73) Assignee: Fujitsu Ten Limited, Kobe-shi (JP)

( * ) Notice: Subject to any disclaimer, the term of this patent is extended or adjusted under 35 U.S.C. 154(b) by 939 days.

(21) Appl. No.: 11/727,360

(22) Filed: Mar. 26, 2007

(65) Prior Publication Data

US 2007/0232087 A1 Oct. 4, 2007

(30) Foreign Application Priority Data

Mar. 30, 2006 (JP) ..... 2006-096166

(51) Int. Cl.
*C23F 13/00* (2006.01)
*C23F 15/00* (2006.01)

(52) U.S. Cl. ..... 205/724; 205/725; 361/2; 361/3; 361/10; 361/103; 307/95; 307/137; 307/138

(58) Field of Classification Search ..... 361/2, 361/3, 10, 103; 307/95, 137, 138; 205/724, 205/725

See application file for complete search history.

(56) References Cited

U.S. PATENT DOCUMENTS 5,523,633 A 6/1996 Imaizumi et al.

FOREIGN PATENT DOCUMENTS

| | | | |
|---|---|---|---|
| JP | 2879807 | * | 1/1999 |
| JP | B2 2879807 | | 1/1999 |
| JP | A 2002-343171 | | 11/2002 |
| JP | A 2005-294198 | | 10/2005 |
| JP | A 2005-294199 | | 10/2005 |
| JP | A 2005-294200 | | 10/2005 |
| JP | A 2006-310287 | | 11/2006 |

* cited by examiner

*Primary Examiner*—Bruce F Bell
(74) *Attorney, Agent, or Firm*—Oliff & Berridge, PLC

(57) ABSTRACT

An input terminal is electrically connected to a contact point. An anti-corrosion current supplying section is operable to supply an anti-corrosion current to the contact point through the input terminal so as to remove corrosion in the contact point. A series resistor is electrically interposed between the input terminal of the signal processing circuit and the contact point. The anti-corrosion current is supplied to the contact point through the series resistor.

14 Claims, 13 Drawing Sheets

SIGNAL PROCESSING DEVICE AND CONTROL UNIT

The disclosure of Japanese Patent Application No. 2006-096166 filed Mar. 30, 2007 including specifications, drawings and claims is incorporated herein by reference in their entirety.

BACKGROUND

The present invention relates to a signal processing device having a signal processing circuit electrically connected to a switching element and capable of supplying an anti-corrosion current to a contact point of the switching element, and a control unit having the same.

FIG. 1 is a circuit diagram illustrating an electrical circuit of a related-art control unit 11. An input terminal 13 of the control unit 11 is electrically connected to a switching element 14. An anti-corrosion current supplying resistance 15 for supplying an anti-corrosion current to the switching element 14 is connected in parallel between the switching element 14 and the input terminal 13 as a discrete component of an integrated circuit 12. In addition, the integrated circuit 12 is provided with a surge protection circuit 16 for absorbing a surge input to the input terminal 13, and a series resistor 18 for externally preventing the integrated circuit 12 from being destroyed by the surge is connected in series. Also, the integrated circuit 12 is provided with a contact logic determination section 17 for determining a contact logic of the switching element 14 on the basis of a voltage of the input terminal 13 (for example, refer to the Japanese Patent No. 2879807).

In the related-art, since the anti-corrosion current supplying resistance 15 is provided as a discrete component, the number of discrete components increases. Accordingly, in the control unit 10 including the integrated circuit 12 having a plurality of input channels, the total number of discrete components significantly increases (It is necessary to prepare the series resistor 18 as a discrete component because the surge input to the integrated circuit 12 should be externally avoided).

SUMMARY

It is therefore an object of the present invention is to provide a signal processing device that externally protects the signal processing circuit as well as reduces the number of discrete components in the signal processing circuit, and a control unit having the same.

In order to achieve the above described object, according to the invention, there is provided a signal processing device electrically connected to a contact point comprising:

a signal processing circuit including:

an input terminal electrically connected to the contact point; and an anti-corrosion current supplying section operable to supply an anti-corrosion current to the contact point through the input terminal so as to remove corrosion in the contact point; and a series resistor electrically interposed between the input terminal and the contact point, wherein:

the anti-corrosion current is supplied to the contact point through the series resistor.

The series resistor may reduce a surge input from the contact point to the signal processing circuit.

According to the above configuration, the anti-corrosion current is supplied to the contact point using the anti-corrosion current supplying section in order to remove corrosion in the contact point. The current value of the anti-corrosion current is determined by a series resistor. In addition, the series resistor allows the breakdown of the signal processing circuit to be avoided by reducing a surge input to the signal processing circuit, and prevents a failure of the signal processing circuit even when the short-circuit breakdown occurs in the signal processing circuit.

With the above configuration, a series resistor is interposed between the contact point and the input terminal. It is possible to allow the series resistor to have both of a function of determining the current value of the anti-corrosion current and a function of avoiding a surge breakdown of the signal processing circuit. In addition, it is possible to reduce the number of components included in the signal processing device. As a result, it is possible to simplify a construction of the signal processing device. Furthermore, since both of the functions are provided in a single series resistor, it is possible to reduce the number of heat sources.

The signal processing device may further comprise:

a current supplying state switching section operable to switch a current supplying state of the anti-corrosion current supplied by the anti-corrosion current supplying section;

a timing signal generating section operable to generate a timing signal which periodically changes and output the generated timing signal to the current supplying state switching section;

wherein the current supplying state switching section switches the current supplying state of the anti-corrosion current based on a change of the output timing signal.

According to the above configuration, the current supplying state switching section switches the current supplying state of the anti-corrosion current on the basis of change of the timing signal output from the timing signal generating section. Therefore, a switching between an anti corrosion current supplying state and an anti-corrosion current non-supplying state is periodically performed.

With the above configuration, the anti-corrosion current cannot be supplied to the contact point for a long time by periodically switching between the anti-corrosion current supplying state and the anti-corrosion current non-supplying state. As a result, it is possible to prevent the contact point from being overheated.

The signal processing circuit may further comprise:

a contact logic determination current supplying section operable to supply a contact logic determination current having a current value smaller than a current value of the anti-corrosion current to the input terminal;

a contact logic determination section electrically connected to the input terminal and operable to determine a connection state of the contact point based on a voltage applied to the input terminal; and a current supplying state switching section operable to switch between an anti-corrosion current supplying state in which the anti-corrosion current is supplied to the input terminal and a contact logic determination state in which the contact logic determination current is supplied to the input terminal and the connection state of the contact point is determined.

According to the above configuration, the anti-corrosion current is supplied to the contact point through the input terminal using the anti-corrosion current supplying section in the anti-corrosion current supplying state. In the contact logic determination state, the contact logic determination current is supplied to the contact point through the input terminal using the contact logic determination current supplying section. The current supplying state switching section can switch between the anti-corrosion current supplying state and the determination logic determination state. The contact logic determination section can determine the connection state of the contact point on the basis of the voltage supplied to the input terminal. As a result, it is possible to separate a period of removing corrosion using the anti-corrosion current and a period of determining the logic state of the contact point using the contact logic determination current by switching between the anti-corrosion current supplying state and the contact logic determination state.

With the above configuration, it is possible to determine the connection state of the contact point using the contact logic determination current having a current value smaller than that of the anti-corrosion current by separating a period of removing corrosion by flowing the anti-corrosion current and a period of determining the connection state by flowing the contact logic determination current. Since the contact logic determination current flows as described above, it is possible to determine the connection state of the contact point even when the series resistor having a large resistance value is interposed. As a result, it is possible to satisfactorily determine the logic state of the contact point even when the series resistor having a large resistance value is interposed between the contact point and the input terminal in order to provide both of the aforementioned functions.

The signal processing device may further comprise:

a timing signal generating section operable to generate a timing signal which periodically changes and output the generated timing signal to the current supplying state switching section, wherein the current supplying state switching section switches between the anti-corrosion current supplying state and the contact logic determination state based on a change of the output timing signal.

According to the above configuration, the current supplying state switching section switches to each state on the basis of the timing signal output from the timing signal generating section. Therefore, a switching between the anti-corrosion current supping state and the contact logic determination state can be periodically performed.

With this configuration, a switching between the anti-corrosion current supplying state and the contact logic determination state is periodically performed. Therefore, it is possible to periodically determine the connection state of the contact point.

The contact logic determination section may be operable to output a determination result of the connection state of the contact point in the contact logic determination state based on the change of the timing signal.

According to the above configuration, the contact logic determination section outputs a determination result in the contact logic determination state.

With this configuration, since the determination result in the contact logic determination state is output, a determination result in the anti-corrosion current supplying state and a determination result in the contact logic determination state do not mixedly exist in the output. As a result, it is possible to readily determine the connection state of the contact point on the basis of the output determination result.

The contact logic determination section may include a voltage reduction unit operable to reduce a voltage applied to the contact logic determination section when the anti corrosion current is supplied through the input terminal.

According to the above configuration, it is possible to reduce the voltage between the input terminal and the contact logic determination section when the anti corrosion current is supplied.

With the above configuration, it is possible to reduce a voltage between the input terminal and the contact logic determination section in the anti-corrosion current supplying state. Since the contact logic determination section determines the connection state of the contact point on the basis of the reduced voltage, the connection state of the contact point can be determined in a low voltage area. As a result, the connection state of the contact point cannot be determined when a high voltage is applied to the contact point by supplying a large current such as the anti-corrosion current. Therefore, it is possible to avoid erroneous determination of the connection state of the contact point, and it is possible to readily determine the connection state of the contact point.

A plurality of the signal processing circuits may be provided in the signal processing device.

The generated timing signal may be output to each of the current supplying state switching sections of the signal processing circuits.

Each of the current supplying state switching sections may switch the current supplying state of the anti-corrosion current based on a change of the output timing signal.

According to the above configuration, a plurality of signal processing circuits having the current supplying state switching section are provided. The current supplying state switching section included in each signal processing at switches its current supplying state on the basis of the timing signal generated in the timing signal generating section.

With this configuration, the current supplying state switching section included in each anti-corrosion circuit switches between the anti-corrosion current supplying state and the contact logic determination state on the basis of the timing signal generated from the timing signal generating section. Therefore, it is not necessary to provide the timing signal generating section in every current supplying state switching section, so that the construction can be simplified.

The timing signal may include a first timing signal and a second timing signal having a timing different from a timing of the first timing signal.

The first timing signal may be output to one of the current supplying state switching sections.

The second timing signal may be output to the other one of the current supplying state switching sections.

According to the above configuration, the first timing signal is output to one of the current supplying state switching sections, and the second timing signal is output to the other one of the current supplying state switching sections. As a result, one of the current supplying state switching sections switches the current supplying state of the anti-corrosion current at a different timing from those of the other one of the current supplying state switching sections.

With the above configuration, one of the current supplying state switching sections switches to the current supplying state of the anti-corrosion current at a different timing from those of the other one of the current supplying state switching sections. As a result, it is possible to prevent the anti-corrosion current from being simultaneously supplied to a plurality of anti-corrosion circuits, and it is possible to prevent a plurality of anti-corrosion circuits from simultaneously generating heat and electromagnetic waves. Since at least one of a plurality of the signal processing circuits generates heat and electromagnetic waves at a different timing from those of other signal processing circuits, it is possible to prevent abnormal heating and avoid aggravation of an output electric field intensity.

The anti-corrosion current supplying section may change the current value of the anti-corrosion current based on a determination result of the connection state of the contact point.

According to the above configuration, it is possible to change the current value of the anti-corrosion current.

With the above configuration, it is possible to change the current value of the anti-corrosion current on the basis of the determination result of the contact logic determination section. For example, when it is determined that the corrosion in the contact point significantly grows, the current value of the anti-corrosion current can be set to a higher value in order to promote removal of the corrosion. When it is determined that there is no corrosion in the contact point, the current value of the anti-corrosion current can be set to a lower value in order to reduce the heat generated in the signal processing circuit.

The signal processing device may further comprise a spark absorption section that absorbs sparks generated when the current supplying state switching section switches between the contact logic determination state and the anti-corrosion current supplying state.

According to the above configuration, it is possible to absorb sparks generated when the current supplying state switching section switches between the contact logic determination state and the anti-corrosion current supplying state.

With the above configuration, it is possible to avoid aggravation of an output electric field intensity by absorbing sparks.

According to the invention, there is also provided a control unit operable to control a driving device, comprising:

the above described signal processing device; and a control section, wherein the control section operable to control the driving device based on the connection state of the contact point.

According to the above configuration, it is possible to implement a control unit comprising the signal processing device.

According to the invention, there is also provided a method for preventing corrosion of a contact point comprising:

supplying an anti-corrosion current to the contact point through a input terminal of a signal processing circuit electrically connected to the contact point and a series resistor electrically interposed between the contact point and the input terminal so as to remove corrosion of the contact point; and reducing a surge input to the signal processing circuit by the series resistor.

According to the above method, it is possible to remove corrosion in the contact point by supplying the anti-corrosion current to the contact point. The current value of the anti-corrosion current is determined by a series resistor. In addition, the series resistor allows the breakdown of the signal processing circuit to be avoided by reducing a surge input to the signal processing circuit, and prevents a failure of the signal processing circuit even when the short-circuit breakdown occurs in the signal processing circuit.

With the above method, a series resistor is interposed between the contact point and the input terminal. Therefore, it is possible to allow the series resistor to have both of a function of determining the current value of the anti-corrosion current and a function of avoiding a surge breakdown of the signal processing circuit. Accordingly, it is possible to reduce the number of components included in the signal processing device. As a result, it is possible to simplify a construction. Furthermore, since both of the functions are provided in a single series resistor, it is possible to reduce the number of heat sources.

According to the invention there is also provided a signal processing circuit having an input terminal electrically connected to a contact point, the signal processing circuit composing:

an anti-corrosion current supplying section operable to supply an anti-corrosion current to the contact point through the input terminal so as to remove corrosion in the contact point;

a current supplying state switching section operable to switch between a current supplying state and a current non-supplying state of the anti-corrosion current in the anti-corrosion current supply; section; and a timing signal generating section operable to generate a timing signal which periodically changes and output the generated timing signal to the current supplying state switching section, wherein the current supplying state switching section switches between the current supplying state and the current non-supplying state of the anti-corrosion current in the anti-corrosion current supplying section based on a change of the timing signal.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Hereinafter, a plurality of embodiments of the present invention will be described with reference to the accompanying drawings. Like reference symbols denote like elements in corresponding parts when the parts that have been already described are referenced in each embodiment, and their descriptions may be omitted. When only a part of the construction is described, other parts are assumed to be similar to those of the preceding one. In addition to a combination of the parts that are specifically described in each embodiment, the embodiments may be partly combined with each other unless the combination does not make any problem.

Figure 1:
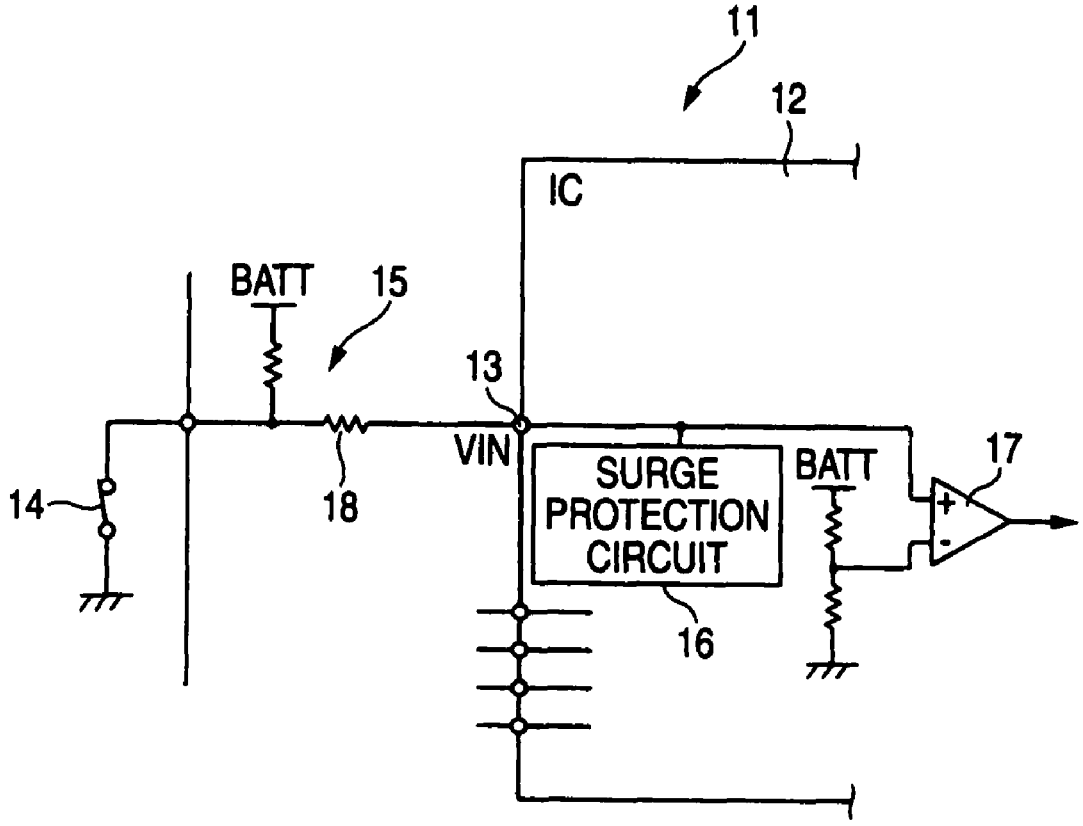
FIG. 1 is a circuit diagram illustrating an electric circuit of a related-art control unit 11.
Figure 2:
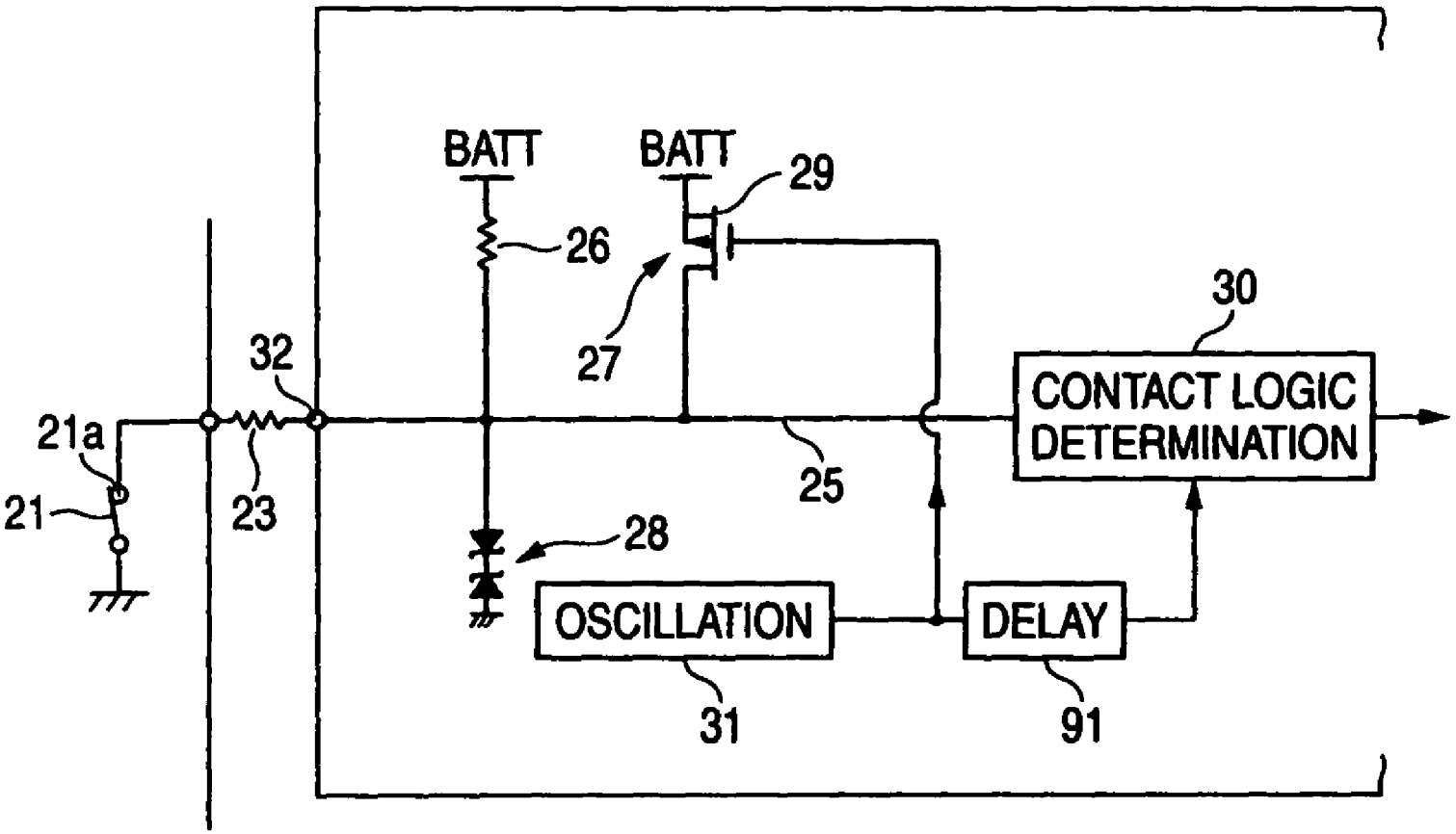
FIG. 2 is a block diagram illustrating an electrical configuration of a signal processing device 20 according to the first embodiment of the present invention.
Figure 3:
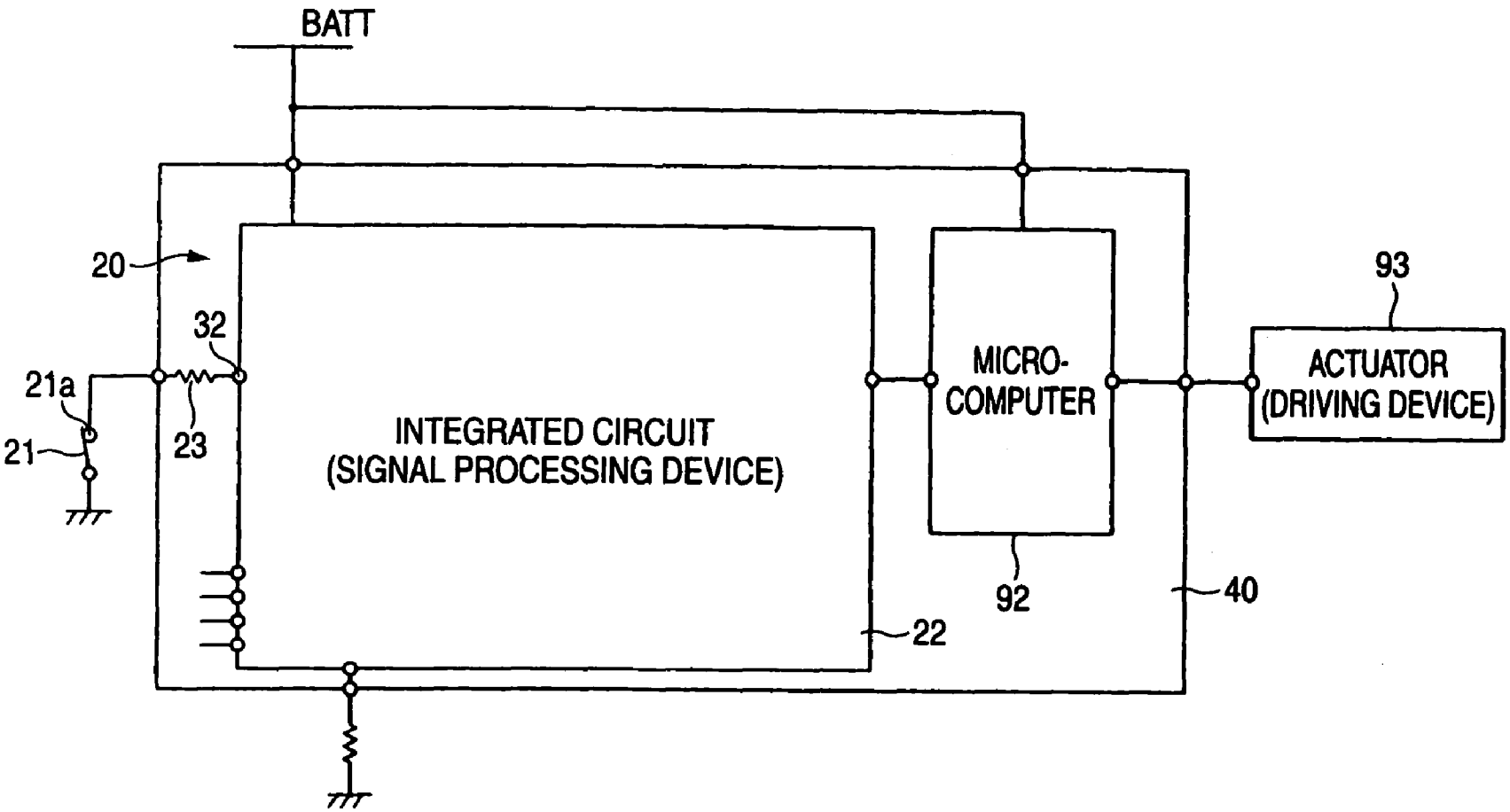
FIG. 3 is a block diagram illustrating an electrical configuration of an ECU 40 comprising a signal processing device 20.
Figure 4:
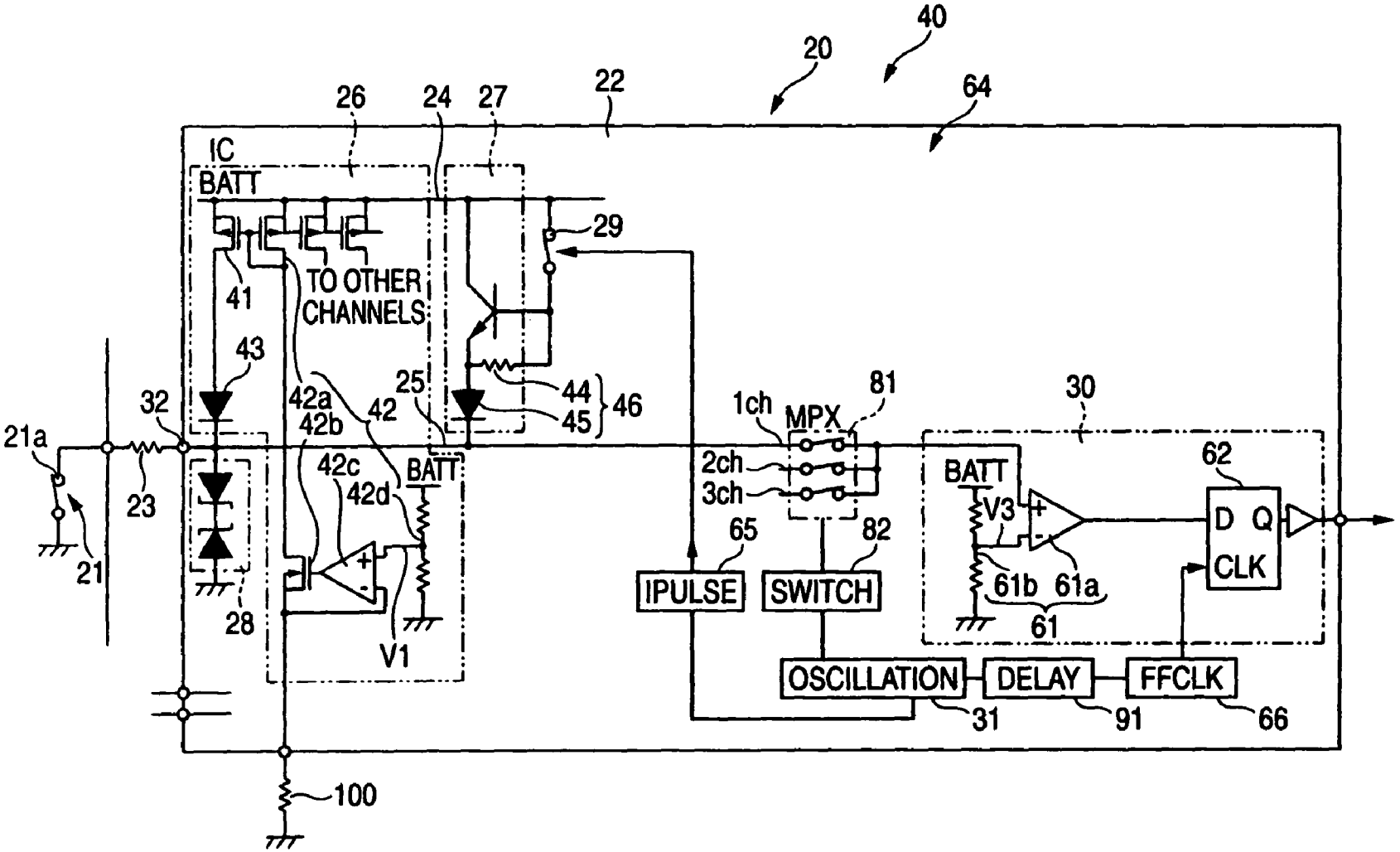
FIG. 4 is a circuit diagram illustrating an electrical circuit of a signal processing device 20.

FIG. 2 is a block diagram illustrating an electric construction of a signal processing device 20 according to the first embodiment of the present invention. FIG. 3 is a block diagram illustrating an electric construction of an ECU 40 having a signal processing device 20. FIG. 4 is a circuit diagram illustrating an electric circuit of the signal processing device 20. The signal processing device 20 is electrically connected to a switching element 21, and capable of supplying an anti-corrosion current to an electric contact point 21*a* in order to remove corrosion in the contact point 21*a* of the switching element 21. The contact point 21*a* of the switching element 21 is used when two terminals of the switching element 21 are connected to each other. The signal processing device 20 is included in an electric control unit hereinafter, referred to as an ECU) 40 as a control unit. The ECU 40 includes a microcomputer 92 and is mounted on a vehicle such as cars. The microcomputer 92 is electrically connected to an actuator 93 such as hydraulic solenoids. The microcomputer 92 has a function of controlling the actuator 93. A power supply (not shown) is electrically connected to the signal processing circuit 20 and the microcomputer 92. The microcomputer 92 is electrically connected to the switching element 21 through the signal processing device 20. The signal processing device 20 determines a connection state (i.e., a logic state) of the contact point 21*a* of the switching element 21, and outputs the determination result to the microcomputer 92. The microcomputer 92 controls the actuator 93, drives a vehicle, or the like, on the basis of the connection state of the contact point 21*a* of the switching element 21. The switching element 21 may be, for example, an overdrive switch, by which the microcomputer 92 controls the drive of the actuator 93 such as a speed-varying hydraulic solenoid when the overdrive switch is turned on. Although the switching element 21 is the overdrive switch in the above description, it is not limited to the overdrive switch but may be other kinds of switches. For example, the switching element 21 may be a brake switch or a hazard switch. Also, the switching element 21 may be a connector. Similarly, the actuator 98 is not limited to the speed-varying hydraulic solenoid. The vehicle contains the aforementioned switch and the actuator. Although the signal processing device 20 is included in the ECU 40 in the above description, it may be included in a control unit mounted on an electronic appliance. The signal processing device 20 includes an integrated circuit (i.e., the signal processing circuit) 22 and a series resistor 23.

The integrated circuit 22 is a cut capable of performing a processing on the basis of the input electric signals and outputting an output electric signal. Basically, the integrated circuit 22 includes a power supply line 24, a conductive path 25, a contact logic determination current supplying section 26, an anti-corrosion current supplying section 27, a surge protection section 28, a current supplying state switching section 29, a contact logic determination section 30, and an oscillation section 31.

The power supply line 24 is electrically connected to a power supply (not shown). The integrated circuit 22 has an input terminal 32 electrically connected to the switching element 21 through a series resistor 23. The conductive path 25 is electrically connected to the input terminal 32.

The contact logic determination current supplying section 26 is a circuit which supplies a contact logic determination current to the conductive path 25 on the basis of the current supplied to the power supply line 24. The contact logic determination current is a current supplied to the switching element 21 in order to determine the connection state of the contact point 21*a* of the switching element 21. The contact logic determination current supplying section 26 has a contact logic determination current supplying portion 41 and a contact logic determination current adjusting portion 42. The contact logic determination current supplying portion 41 is connected in parallel between the power supply line 24 and the conductive path 25. The contact logic determination current supplying portion 41 is so called a field effect transistor (hereinafter, referred to as an FET), of which a source is electrically connected to the power supply line 24, and the drain is electrically connected to the conductive path 25. Also, a substrate is electrically connected to the source. Hereinafter, unless defined otherwise, the FET is assumed to be any of a depletion mode FET and an enhancement mode FET. In addition, the contact logic determination current supplying portion 41 may be a bipolar transistor instead of the FET. A diode 43 is electrically interposed between the drain of the contact logic determination current supplying portion 41 and the conductive path 25, so that the current cannot backwardly flow from the conductive path 25 to the power supply line 24.

The contact logic determination current adjusting portion 42 has a function of adjusting the current value of the current flowing from the power supply line 24 to the conductive path 25 through the contact logic determination current supplying portion 41. The contact logic determination current adjusting portion 42 adjust a voltage applied to the gate of the contact logic determination current supplying portion 41 on the basis of the current value of the current flowing through the power supply line 24 and the current flowing through the contact logic determination current supplying portion 41. According to the present embodiment, the contact logic determination current adjusting portion 42 has two FETs 42*a* and 42*b*, a comparator (operational amplifier) 42*c*, and an adjustment voltage dividing circuit 42*d*. However, the contact logic determination current adjusting portion 42 is not limited to such a construction.

Both of the FETs 42*a* and 42*b* are connected in series between the power supply line 24 and the ground. The FET 42*a* (also, referred to as a upstream FET 42*a*) disposed near the power supply line 24 has a source electrically connected to the power supply line 24 and a drain electrically connected to the drain of the FET 42*b* (also referred to as a downstream FET 42*b*) near the ground. In addition, the gate of the upstream FET 42*a* is electrically connected to the drain of the upstream FET 42*a* and the gate of the contact logic determination current supplying portion 41. The source of the downstream FET 42*b* is grounded through a resistor.

An operational amplifier 42*c* has an inverted input terminal electrically connected to the source of the downstream FET 42*b* and an non-inverted input terminal electrically connected to the adjustment voltage dividing circuit 42*d*. The output terminal of the operational amplifier 42*c* is electrically connected to the gate of the downstream FET 42*d*. The adjustment voltage dividing circuit 42*d* is a kind of voltage dividing circuits and electrically connected to the power supply line 24 so as to be grounded. The adjustment voltage dividing circuit 42*d* divides the voltage applied to the power supply line 24 in order to allow the divided limit voltage V1 to be applied to the non-inverted input terminal of the operational amplifier 42*c*. The limit voltage V1 is, for example, 7V.

The anti-corrosion current supplying section 27 has a function of supplying the anti-corrosion current to the contact point 21*a* of the switching element 21. The anti-corrosion current is used to remove the corrosion in the contact point 21*a* of the switching element 21, and has a current value significantly larger than that of the electrical signal transmitted in the signal processing. The anti-corrosion current is set to be also larger than the contact logic determination current. For example, the anti-corrosion current may be set to 15 mA, and the contact logic determination current may be set to 1.5 mA. According to the present embodiment, the anti-corrosion current supplying section 27 is an NPN type transistor having an collector electrically connected to the power supply line 24 and an emitter electrically connected to the conductive path 25. However, the anti-corrosion current supplying section 27 is not limited to the NPN type transistor, but may be a PNP type transistor.

Since the emitter and the base of the anti-corrosion current supplying section 27 are electrically connected to each other through a current restricting resistor 44, the anti-corrosion current is inhibited when the contact logic is determined. A backward flow prevention section 45 is interposed between the emitter of the anti-corrosion current supplying section 27 and the conductive path 25. According to the present embodiment, the backward flow prevention section 45 is a diode having an anode electrically connected to the anti-corrosion current supplying section 27 and a cathode electrically connected to the conductive path 25, so that the current flowing to the power supply line 24 is prevented when the voltage applied to the input terminal 32 increases. The anti-corrosion current supplying section 27 has a function of supplying the anti-corrosion current limited by the series resistor 23.

The surge protection section 28 functioning as a surge absorption section absorbs the surge applied to the input terminal 32, (i.e., the surge applied to the integrated circuit 22). The surge protection section 28 has two Zener diodes connected in series. Its one end is electrically connected to the conductive path 25, while the other end is grounded. The cathodes of the two Zener diodes are electrically connected to each other. Also, the anode of one of the Zener diodes is electrically connected to the conductive pith 25, while the anode of the other is grounded. However, the surge protection section 28 is not limited to such a construction.

The current supplying state switching section 29 is used to switch between the anti-corrosion current supplying state and the contact logic determination state. The current supplying state switching section 29 may be, for example, a switch that can be turned on or off in synchronization with the IPULSE signal transmitted from the oscillation section 31. The current supplying state switching section 29 is electrically connected to the current restricting resistor 44 in series and has one end electrically connected to the power supply line 24 and the other end is electrically connected to the current restricting resistor 44. In the current supplying state switching section 29, the base of the anti-corrosion current supplying section 27 is connected in parallel with the current restricting resistor 44. In the anti-corrosion current supplying state, the anti-corrosion current is supplied to the contact point 21*a* of the switching element 21 through the input terminal 32. In the contact logic determination state, the contact logic determination current is supplied to the contact point 21*a* of the switching element 21 through the input terminal 32.

The contact logic determination section 30 has a function of intermittently determining the logic state of the contact point 21*a* of the switching element 21 on the basis of the voltage of the conductive path 35 (i.e., the voltage of the input terminal 32). According to the present embodiment, the contact logic determination section 30 has a contact logic determination portion 61 and a determination result output portion 62. The contact logic determination portion 61 includes a comparator 61*a* and a determination voltage dividing circuit 61*b*.

The comparator 61*a* has a non-inverted input terminal electrically connected to the conductive path 25 and an inverted input terminal electrically connected to the determination voltage dividing circuit 61*b*. The determination result output portion 62 is electrically connected to the output terminal of the comparator 61*a*. The determination voltage dividing circuit 61*b* is a kind of voltage dividing circuits for dividing the voltage applied to the power supply line 24 to generate a contact logic reference voltage V3 and apply the contact logic reference voltage V3 to the inverted input terminal of the comparator 61*a*. The contact logic reference voltage V3 is set to, for example, 7V, and used to determine whether or not the contact point 21*a* of the switching element 21 is connected when the contact logic determination current flows. According to the present embodiment, the determination voltage dividing comparator 61*b* has two resistors connected in series, and its one end is connected to the power supply line 24 while the other end is grounded.

The determination result output portion 62 has a function of outputting the logic state of the contact point 21*a* of the switching element 21 in the contact logic determination state. According to the present embodiment, the determination result output portion 62 includes a D-type flip-flop having one input terminal D electrically connected to the output terminal of the contact logic determination portion 61 (i.e., the output terminal of the comparator 61*a*) and the other input terminal CLK electrically connected to the oscillation section 31. The output terminal Q of the determination result output portion 62 may be electrically connected to, for example, a microcomputer. The determination result output portion 62 outputs the signal input to the terminal D from the terminal Q on the basis of the FFCLK signal input to the terminal CLK.

Figure 5:
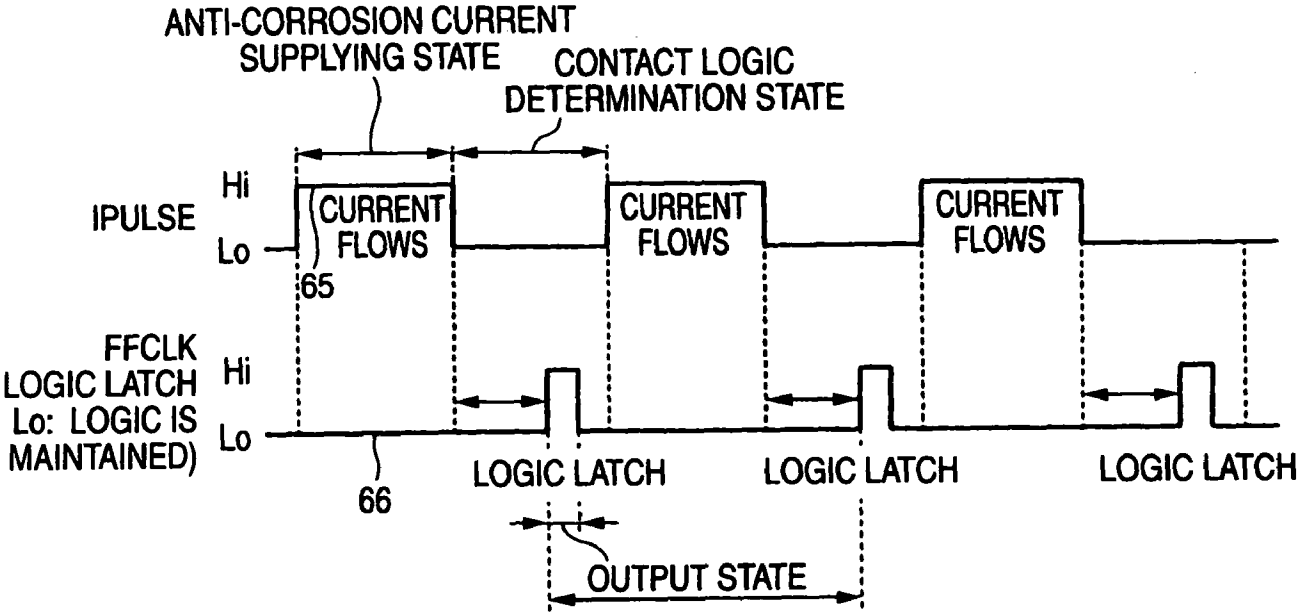
FIGS. 5(*a*) and 5(*b*) are a timing chart illustrating a timing of a FFCLK signal 66 and an IPULSE signal 65 oscillated from an oscillating section 31.

FIGS. 5(*a*) and 5(*b*) are a timing chart illustrating a timing of the FFCLK signal 66 and the IPULSE signal 65 oscillated from the oscillating section 31. In FIG. 5, the abscissa represents an elapsed time, and the ordinate represents a high level Hi and a low level Lo. The oscillation section 31 functioning as a timing signal generating section is a kind of oscillation circuits capable of oscillating the IPULSE signal 65 and the FFCLK signal 66. The oscillation section 31 may be, for example, an oscillation circuit. However, the oscillation section 31 is not limited to the oscillation circuit, but may be a central processing unit (CPU). As shown in FIGS. 5(*a*) and 5(*b*), the IPULSE signal 66 functioning as a timing signal has a signal level periodically switching between the high level Hi and the low level Lo and is transmitted from the oscillation section 31 to the current supplying state switching section 29. The current supplying state switching section 29 has a faction of switching between the anti-corrosion current supplying state (e.g., when the switch is turned on) and the contact logic determination state (e.g., when the switch is turned on) on the basis of the IPULSE signal 65.

A delay circuit 91 is interposed between the oscillation section 31 and the determination result output section 62. The FFCLK signal 66 has a signal level periodically switching between the high level Hi and the low level Lo. As shown in FIG. 5(*b*), the FFCLK signal 66 is triggered from the low level Lo to the high level Hi after a predetermined stable period of several microseconds (μs) in response to the falling edge of the IPULSE signal 65 output from the oscillation section 31 (i.e., after the switch of the current supplying state switching section 29 is turned off). The FFCLK signal 66 is transmitted and input to the CLK terminal of the determination result output portion 62.

According to the present embodiment, a clock period of the IPULSE signal 65 and the FFCLK signal 66 is 100 μs. The IPULSE signal 65 has a duty ratio of 50% so as to switch between the high and low levels Hi and Lo every 50 μs while the FFCLK signal 66 has a duty ratio of 10%. The duty ratio is a ratio of the time length of the high level Hi dug a clock period. However, the dock period is not limited to 100 μs, and also, the duty ratio is not limited to 50% or 10%.

A circuit including the power supply line 24, the conductive path 25, the contact logic determination current supplying section 26, the anti-corrosion current supplying section 27, the surge protection section 28, the current supplying state switching section 29, the contact logic determination section 30, the oscillation section 31, and the input terminal 32 corresponds to an anti-corrosion circuit 64 functioning as a signal processing circuit. According to the present embodiment, the anti-corrosion circuit 64 is included in the integrated circuit 22.

The series resistor 23 is connected in series between the integrated circuit 22 and the switching element 21. The resistance of the series resistor is set to, for example, 1 kΩ. The series resistor is set to allow the anti-corrosion current to flow and has a function of reducing the voltage applied to the integrated circuit 22 (specifically, the voltage applied to the conductive path 25) when the anti-corrosion current flows through the switching element as well as reducing the surge input to the conductive path 25 from the outside of the integrated circuit 22, in order to prevent a breakdown caused by the surge. The series resistor 23 is provided to achieve both functions described above. Therefore, the anti-corrosion current value and the surge reduction value are set by only a single series resistor 23.

Hereinafter, an operation of the signal processing device 20 and an operation of determining the contact logic when the two contact points of the switching element 21 make contact with each other will be described. Firstly, the description is given for a case where the IPULSE signal 65 output from the oscillation section 31 is at a low level Lo. When the oscillation section 31 outputs the IPULSE signal 65 having a low level Lo, the current supplying state switching section 29 switches a current path between the power line 24 and the current restricting resistor 44 to a shutoff condition on the basis of the IPULSE signal 65 having a low level Lo. When the current path between the power line 24 and the current restricting resistor 44 switches to the shutoff condition, the contact logic determination current is supplied to the power supply line 24 and the conductive path 25. The contact logic determination current is adjusted by the contact logic determination current adjustment portion 42.

Specifically, since the voltage of the source of the downstream FET 42*b* is set to a value smaller than the limit voltage V1, a signal having a high level Hi is output from the operational amplifier 42*c*, and the source-drain path of the downstream FET 42*b* is connected. As a result, the contact logic determination current flows from the power supply line 24 to the upstream and downstream FETs 42*a* and 42*b* to the resistor 100. When the voltage of the source of the downstream FET 42*b* becomes larger than the limit voltage V1 due to such a current flow, a signal having a low level Lo is output from the operational amplifier 42*c*, so that the amount of the current flowing between the source and the drain of the downstream FET 42*b* is limited. This reduces the voltage applied across the drains of the upstream and downstream FETs 42*a* and 42*b*. Simultaneously with this voltage reduction, the voltage applied to the base of the contact logic determination current supplying portion 41 is reduced, and the contact logic determination current flowing between the source and the drain of the contact logic determination current supplying portion 41 is also reduced. Accordingly, the current value of the contact logic determination current is limited on the basis of the current flowing from the power supply line 24 through the upstream and downstream FETs 42*a* and 42*b* and the resistor 100 to the ground. In other words, an upper limitation value of the contact logic determination current can be set by the resistance of the resistor 100, and it is possible to prevent abnormal increase of the current value of the contact logic determination current as well as the voltage of the power supply line 24. As a result, it is possible to avoid a surge breakdown.

Subsequently, a case where the IPULSE signal 65 output from the oscillation section 31 has a high level Hi will be described. When the oscillation section 31 outputs a corrosion removal signal corresponding to the IPULSE signal 65 having a high level Hi, the current supplying state switching section 29 connects a current path between the power supply line 24 and the current restricting resistor 44 on the basis of the corrosion removal signal. When the current supplying state of the current supplying state switching section 29 is changed as described above, the anti-corrosion current is supplied to the conductive path 25 by the anti-corrosion current supplying section 27, and the anti-corrosion current flows to the contact point 21*a* of the switching element 21 via the anti-corrosion current supplying section 27, the backward flow prevention section 45, and the series resistor 23. When the corrosion removal signal is output from the oscillation section 31 as described above, the current supplying state switching section 29 switches to the anti-corrosion current supplying state in which the anti-corrosion current is supplied to the switching element 21. In this case, the anti-corrosion current is limited under a predetermined current value due to the series resistor 23.

If the IPULSE signal 65 having a low level Lo is output from the oscillation section 31 in this condition, the current supplying state switching section 29 disconnects a current path between the power supply line 24 and the current restricting resistor 44 on the basis of the IPULSE signal having a low level Lo. As a result, the contact logic determination current is supplied from the power supply line 24 to the conductive path 25 by the contact logic determination current supplying section 26. The contact logic determination current flows to the contact point 21*a* of the switching element 21 and the non-inverted input terminal of the comparator 61*a* via the conductive path 25.

The comparator 61*a* determines whether the voltage of the conductive path 25 is larger than or smaller than the contact logic reference voltage V3. If the voltage of the conductive path 25 is larger than the contact logic reference voltage V3, the comparator 61*a* determines that the contact point 21*a* of the switching element 21 is not connected, and outputs a signal having a high level Hi. This signal is input to the terminal D of the determination result output portion 62. If the voltage of the conductive path 25 is smaller than the contact logic reference voltage V3, the comparator 61*a* determines that the contact point 21*a* of the switching element 21 is connected, and outputs a signal having a low level Lo. This signal is input to the terminal D of the determination result output portion 62. The contact logic can be determined as described above.

When the FFCLK signal 66 oscillated from the oscillation section 31 switches from a low level Lo to a high level Hi, the determination result output portion 62 outputs a signal (i.e., the determination result of the contact logic having a level equal to that of the signal input from the terminal Q to the terminal D. The FFCLK signal 66 temporarily switches to a high level Hi by the delay signal 91 when the PULSE signal 65 has a low level Lo. Therefore, during the contact logic determination current is supplied to the conductive path 25, an electric signal representing the contact logic is output from the determination result output portion 62. If the IPULSE signal 65 having a low level Lo is output from the oscillation section 31 as a corrosion removal signal as described above, the current supplying state switching section 29 switches to the contact logic determination state in which the logic state of the contact point 21*a* of the switching element 21 is determined.

Hereinafter, effects caused by the signal processing device 20 having the aforementioned construction will be described in the signal processing device 20 according to the present embodiment, the series resistor 23 is interposed between the contact point 21*a* of the switching element 21 and the input terminal 32. Therefore, it is possible to allow the series resistor 23 to provide both of a function of determining the current value of the anti-corrosion current and a function of avoiding the breakdown of the integrated circuit 22. Also, it is possible to reduce the number of components in the signal processing device 20. As a result, it is possible to simplify the construction of the signal processing device 20. Furthermore, since the series resistor 23 has both functions as described above, it is possible to reduce the number of heat sources.

In addition, in the signal processing device 20, it is possible to avoid a surge breakdown of the integrated circuit 22 using the series resistor 23 by reducing the voltage applied to the input terminal 32 when the surge protection section 28 is broken down by a surge. Therefore, it is possible to improve safety by providing the series resistor 23. Also, since the series resistor 23 for determining the current value of the anti-corrosion current as described above is prepared using a discrete component, it is possible to dispose a hear source which generates a large amount of heat in the outside of the integrated circuit 22 having a plurality of heat sources. Therefore, it is possible to reduce the amount of heat generated in the integrated circuit 22.

In the signal processing device 20 according to the present embodiment, a periodic switching between an anti-corrosion current supplying state and an anti-corrosion current shutoff state is performed, so that it is possible to prevent the anti-corrosion current from flowing to the contact point 21*a* for a long time. As a result, it is possible to avoid an overheating of the contact point 21*a*.

In the signal processing device 20 according to the present embodiment, it is possible to determine the logic state of the contact point 21*a* of the switching element 21 using the contact logic determination current having a current value smaller than that of the anti-corrosion current by separating a period of removing corrosion by flowing the anti-corrosion current and a period of determining a contact logic by flowing the contact logic determination current. Since the contact logic determination current flows as described above, it is possible to determine the connection state of the contact point 21*a* of the switching element 21 even when the series resistor 23 having a large resistance value is interposed. As a result, it is possible to satisfactorily determine the logic state of the contact point 21*a* of the switched element 21 even when the series resistor 23 having a large resistance value is interposed between the contact point 21*a* of the switching element 21 and the input terminal 32 in order to have both of the aforementioned functions.

In the signal processing device 20 according to the present invention, a resistor having a large resistance value can be used as the series resistor 23. As a result, it is possible to reduce the voltage applied to the input terminal 32, and to avoid a surge breakdown of the integrated circuit 22.

In the signal processing device 20 according to the present invention, a periodic switching between the anti-corrosion current supplying state and the contact logic determination state is performed. Therefore, it is possible to periodically determine the logic state of the contact point 21*a* of the switching element 21.

In the signal processing device 20 according to the present embodiment, since the determination result in the contact logic determination state is output from the determination result output portion 62, a determination result in the anti-corrosion current supplying state and a determination result in the contact logic determination state do not mixedly exist in the output. As a result, it is possible to readily determine the logic state of the contact point 21*a* of the switching element 21.

In the signal processing device 20 according to the present embodiment, the determination result output portion 82 outputs the determination result on the basis of the FFCLK signal 66. The FFCLK signal 66 switches from a low level Lo to a high level Hi after a delay time from the time point that the IPULSE signal 65 switches from a high level Hi to a low level Lo (i.e., a switching to the contact logic determination state is performed), so as to output the determination result. Due to the delay time, the charges remaining in the conductive path 25 after the flow of the anti-corrosion current stops can be removed as much as possible. As a result, it is possible to prevent erroneous determination of the contact logic.

In the signal processing device 20 according to the present embodiment, it is possible to implement a control unit 40 having a series resistor 23 and an integrated circuit 22 having an anti-corrosion function.

Figure 6:
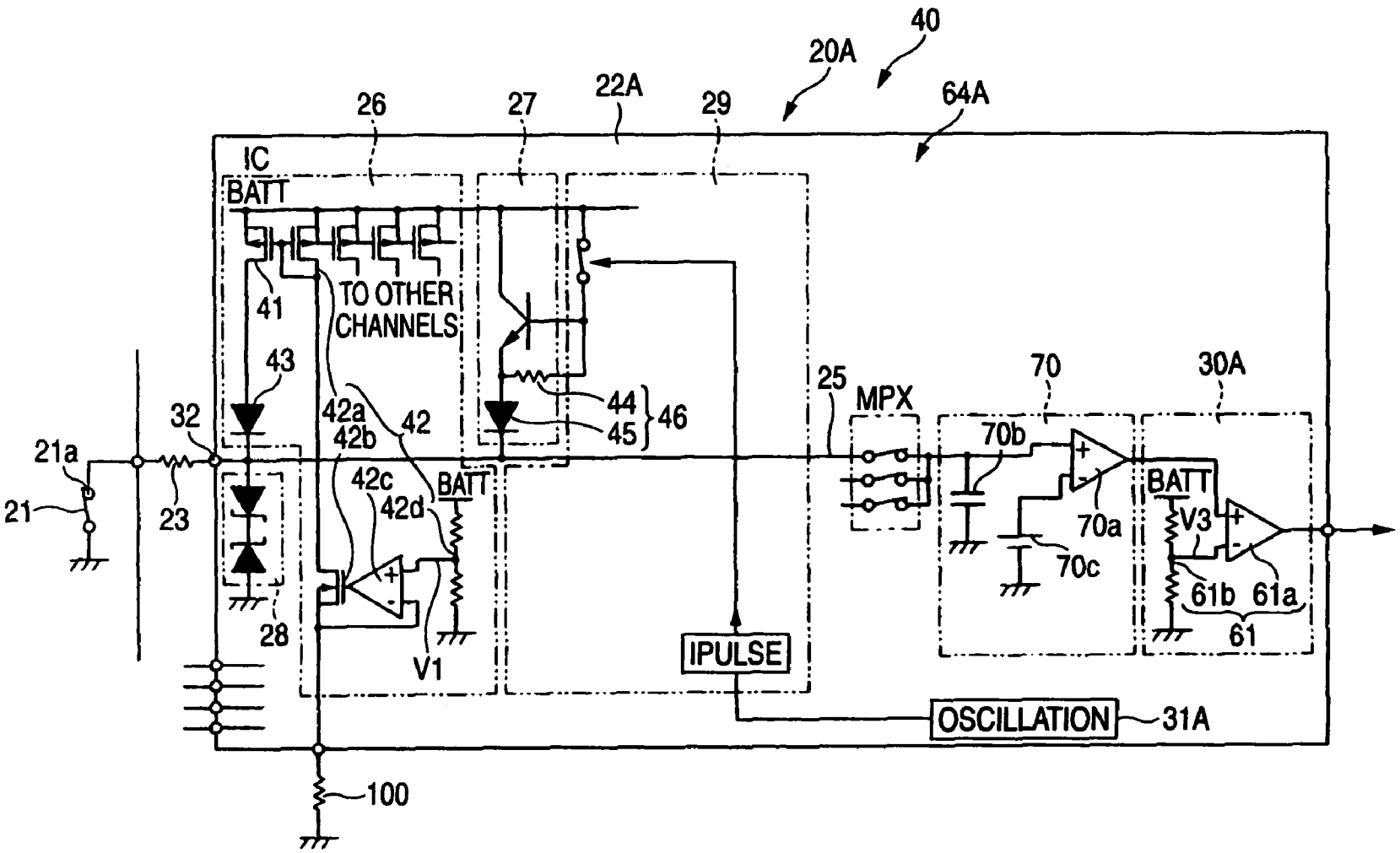
FIG. 6 is a circuit diagram illustrating an electric circuit of a signal processing device 20A according to the second embodiment.

FIG. 6 is a circuit diagram illustrating an electric circuit of a signal processing device 20A according to the second embodiment. The signal processing device 20A according to the second embodiment has a construction similar to that of the signal processing device 20 according to the first embodiment. Accordingly, the description of the signal processing device 20A according to the second embodiment will be given only for components different from those of the signal processing device 20 according to the first embodiment, and will not be given for similar components, wherein like reference symbols denote like components. The signal processing device 20A includes an integrated circuit 22A and a series resistor 28. Basically, the integrated circuit 22A includes an anti-corrosion circuit 64A having a power supply line 24, a conductive path 25, a contact logic determination current supplying section 26, an anti-corrosion current supplying section 27, a surge protection section 28, a current supplying state switching section 29, a contact logic determination section 30A, an oscillation section 31A, and an input terminal 32.

The contact logic determination section 30A includes a contact logic determination portion 61, and a voltage reduction portion 70 is interposed between the input terminal 32 and the contact logic determination portion 61. The voltage reduction portion 70 has a circuit equivalent to a sample/hold circuit of an analog-digital converter in order to maintain a high frequency components in the current flowing through the conductive path 25 and reduce the voltage. The voltage reduction portion 70 includes a comparator 70*a*, a capacitor 70*b*, and a reference power supply 70*c*. A non-inverted input terminal of the comparator 70*b* is electrically connected to the conductive path 25. The capacitor 70*b* is connected to the conductive path 25 in parallel with the non-inverted input terminal of the comparator 70*a* so as to be grounded. The reference power supply 70*c* is electrically connected to the inverted input terminal of the comparator 70*a* so as to apply a reference voltage to the non-inverted input terminal of the comparator 70*a*. The output terminal of the comparator 70*a* is electrically connected to the non-inverted input terminal of the comparator 61*a* of the contact logic determination portion 61.

The oscillation section 31A allows the corrosion removal signal generating portion 52 to have a IPULSE signal having a duty ratio of, for example, 10%. However, the duty ratio of the IPULSE signal is not limited to 10%, but may be smaller than 10% as long as it has a high frequency component. As a result, the anticorrosion current is supplied to the conductive path 25 on the bass of a given IPULSE signal.

Hereinafter, operations of the voltage reduction portion 70 and the contact logic determination section 30A will be described. When the contact logic determination current flows to the conductive path 25, the capacitor 70*b* is charged, and simultaneously, a voltage is applied to the non-inverted input terminal of the comparator 70*a*. The comparator 70*a* compares the applied voltage (i.e., the voltage of the conductive path 25) with the reference voltage.

If the voltage of the conductive path 26 is larger than or equal to the reference voltage, an electric signal having a high level Hi is output from the comparator 70*a*, and input to the non-inverted input terminal of the contact logic determination portion 61. The voltage of the electric signal having a high level Hi is set to a value larger than the contact logic reference voltage V3. When an electric signal having a high level Hi is output from the comparator 70*a*, an electric signal having a high level Hi (which section an unconnected state) is output from the comparator 61*a* of the contact logic determination portion 61.

If the voltage of the conductive path 25 is smaller than the reference voltage, an electric signal having a low level Lo is output from the comparator 70*a*, and input to the non-inverted input terminal of the contact logic determination portion 61. The voltage of the electric signal having a low level Lo is set to a value smaller than the contact logic reference voltage V3. When an electric signal having a low level Lo is output from the comparator 70*a*, an electric signal having a low level Lo (which section a connected state) is output from the comparator 61*a* of the contact logic determination portion 61.

In addition, the anti-corrosion current flows to the conductive path 25, the capacitor 70*b* is charged. Since the IPULSE signal having a high frequency component and a duty ratio of for example, 10% is oscillated, the time of supplying the anti-corrosion current is short. Therefore, the capacitor 70*b* is not sufficiently charged by the anti-corrosion current, so that the voltage applied to the non-inverted input terminal of the comparator 70*a* does not increase but decreases. Since the voltage applied to the non-inverted input terminal is reduced as described above, the contact point 21*a* of the switching element 21 is connected, so that the comparator 70*a* always outputs an electric signal having a low level from the output terminal. As a result, the logic state of the contact point is not determined by the anti-corrosion current, and the contact logic determination portion 61 cannot determine the logic state of the contact point in the anti-corrosion current supplying state.

In the signal processing device 20A according to the present embodiment, it is possible to reduce a voltage using the voltage reduction portion 70 in the anti-corrosion current supplying state. Since the contact logic determination portion 61 determines the logic state of the contact point 21*a* of the switching element 21 on the basis of the reduced voltage, the logic state of the contact point 21*a* of the switching element 21 can be determined in a constant voltage area. As a result, the logic state of the contact point 21*a* cannot be determined when a high voltage is applied to the contact point 21*a* of the switching element 21 by supplying a large current such as the anti-corrosion current. Therefore, it is possible to avoid erroneous determination of the logic state of the contact point, and it is possible to readily determine the logic state of the contact point 21*a* of the switching element 21.

Since the signal processing device 20A according to the present embodiment has a construction similar to that of the signal processing device 20 according to the first embodiment, it can provide effects similar to those of the signal processing device 20 according to the first embodiment.

Figure 7:
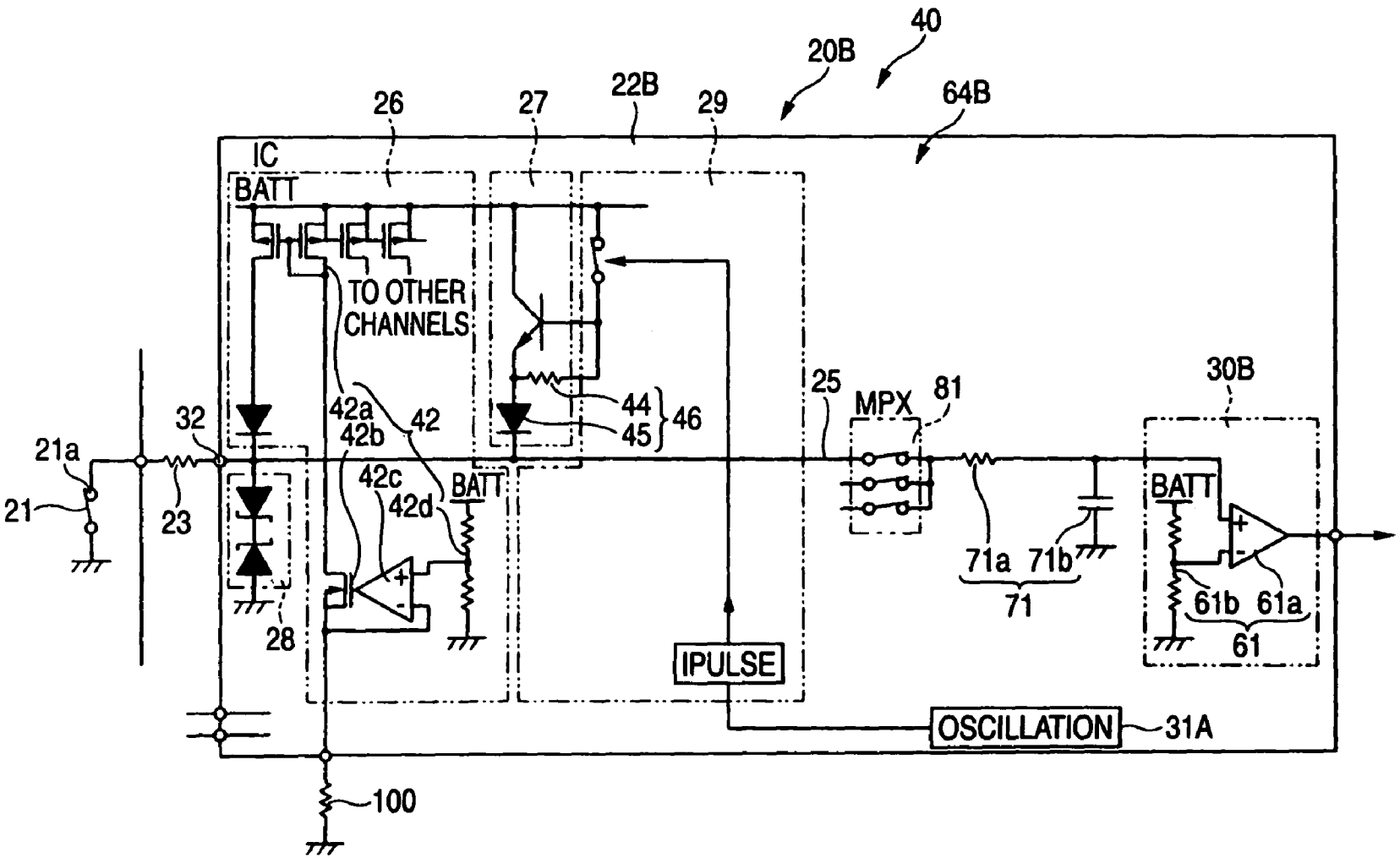
FIG. 7 is a circuit diagram illustrating an electric circuit of a signal processing device 20B according to the third embodiment.

FIG. 7 is a circuit diagram illustrating an electric circuit of a signal processing device 20B according to the third embodiment. The signal processing device 20B according to the third embodiment has a construction similar to that of the signal processing device 20 according to the first embodiment. Accordingly, the description of the signal processing device 20B according to the third embodiment will be given only for components different from those of the signal processing device 20 according to the first embodiment, and will not be given for similar components, wherein like reference symbols denote like components. The signal processing device 20B includes an integrated circuit 22B and a series resistor 23. Basically, the integrated circuit 22B includes an anti-corrosion circuit 64B having a power supply line 24, a conductive path 25, a contact logic determination current supplying section 26, an anti-corrosion current supplying section 27, a surge protection section 28, a current supplying state switching section 29, a contact logic determination section 30B, an oscillation section 31A, and an input terminal 32.

The contact logic determination section 30B includes a contact logic determination portion 61, and a low pass filter 71 is interposed between the input terminal 32 and the contact logic determination portion 61. Specifically, the low pass filter 71 is interposed between the conductive path 25 and the non-inverted input terminal of the contact logic determination portion 61. According to the present embodiment, the low pass filter 71 includes a resistor 71*a* and a capacitor 71*b*. Since the time for supplying the anti-corrosion current is short, the anti-corrosion current is filtered by the low pass filter 71 and does not reach the contact logic determination portion 61. Therefore, the logic state of the contact point cannot be determined during the anti-corrosion current is supplied. As a result, the logic state of the contact point is determined only in the contact logic determination state, while the logic state of the contact point cannot be determined in the anti-corrosion current supplying state. Accordingly, it is possible to readily determine the logic state of the contact point.

Figure 8:
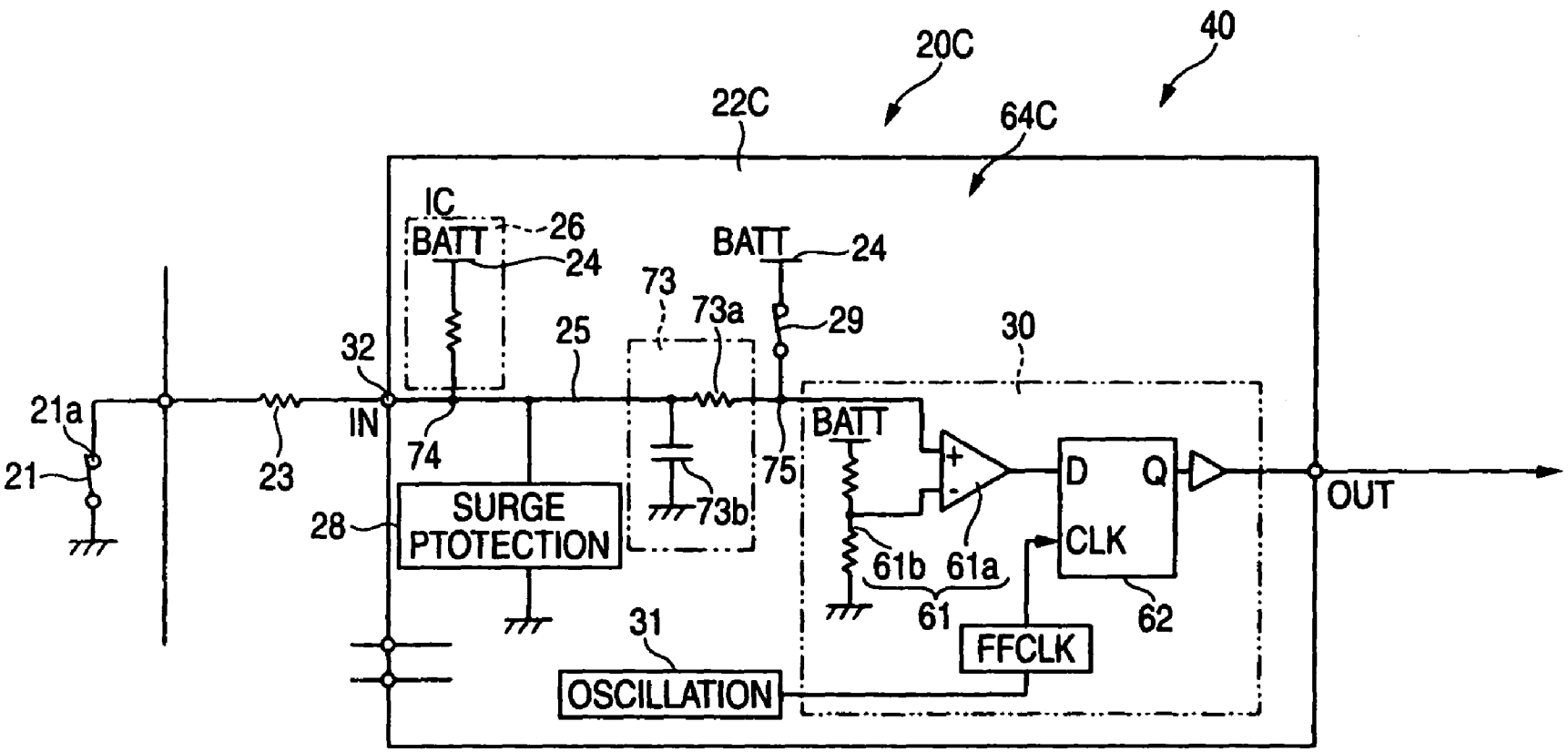
FIG. 8 is a circuit diagram schematically illustrating an electric circuit of a signal processing device 20C according to the fourth embodiment.

FIG. 8 is a circuit diagram schematically illustrating an electric circuit of a signal processing device 20C according to the fourth embodiment. The signal processing device 20C according to the fourth embodiment has a construction to that of the signal processing device 20 according to the first embodiment. Accordingly, the description of the signal processing device 20C according to the fourth embodiment will be given only for components different from those of the signal processing device 20 according to the first embodiment, and will not be given for similar components, wherein like reference symbols denote like components. In comparison with the signal processing device 20 according to the first embodiment, the signal processing device 20C has a spark absorption section 73. Specifically, in comparison with the anti-corrosion circuit 64 according to the first embodiment, the anti-corrosion circuit 64C has a spark absorption section 73.

The spark absorption section 73 absorbs sparks generated when a switching between the contact logic determination state and the anti-corrosion current supplying state is performed (i.e., when the current flow switches from the contact logic determination current to the anti-corrosion current). The sparks may be instantaneously generated by an abnormal current when the current value is abruptly changed in a short time period. The spark absorption section 73 is provided between the contact logic determination current supplying section 26 and the anti-corrosion current supplying section 29 and between the branch points 74 and 75 of the conductive path 25.

The spark absorption section 73 has a resistor 73*a* and a capacitor 73*b*. The resistor 73*b* is inserted into the conductive path 25, and the capacitor 73*b* is connected between an upstream side from the resistor 73*a* in the conductive path 25 and the ground. The spark absorption section 73 constructed as described above absorbs the sparks generated in the conductive path 25 using the capacitor 73*b*. As a result, it is possible to avoid a breakdown of the integrated circuit 22C caused by the sparks. In addition, in the signal processing device 20 according to the present embodiment, it is possible to prevent aggravation of an output electric field intensity by absorbing the sparks.

Hereinafter, a signal processing device 20D according to the fifth embodiment will be described with reference to FIGS. 2 to 4. The signal processing device 20D according to the fifth embodiment has a construction similar to that of the signal processing device 20 according to the first embodiment. Accordingly, the description of the signal processing device 20D according to the fifth embodiment will be given only for components different from those of the signal processing device 20 according to the first embodiment, and will not be given for similar components, wherein like reference symbols denote like components. The integrated circuit 22D of the signal processing device 20D includes a plurality of anti-corrosion circuits 64. Specifically, the integrated circuit 22D has a plurality of channels (i.e., a plurality of input terminals 32). In the integrated circuit 22D, each anti-corrosion circuit 64 is provided for each channel. More specifically, each anti-corrosion circuit 64 shares the power supply line 24 and the contact logic determination portion 30. Since each anti-corrosion circuit 64 shares the contact logic determination portion 30, the integrated circuit 22D has a multiplexer 81 (hereinafter, referred to as an MPX 81). The MPX 81 is electrically connected to a corrosion determination conductive path of each anti-corrosion circuit 64 and has an output electrically connected to the non-inverted input terminal of the contact logic determination portion 61. The MPX 81 has a function of switching the conductive path 25 electrically connected to the non-inverted input terminal of the contact logic determination portion 61 to any one of a plurality of conductive paths 25.

The oscillation section 31D is, for example, a CPU and has a construction capable of oscillating the IPULSE signal 65, the FFCLK signal 66, and the switching signal 82. The oscillation section 311D transmits the IPULSE signal 65 to the current supplying state switching section 29 of each anti-corrosion circuit 64, and also transmits the FFCLK signal 66 to the CLK terminal of the determination result output portion 62. As a result, the current supplying state switching section 29 included in each anti-corrosion circuit 64 switches between the anti-corrosion current supplying state and the contact logic determination state on the basis of the IPULSE signal 65 output from the oscillation section 31D. In addition, the oscillation section 31D transmits the switching signal 82 to the MPX 81. The MPX 81 switches the connected conductive path 25 to any one of the conductive paths 25 on the basis of the switching signal 82 output from the oscillation section 31D.

Figure 9:
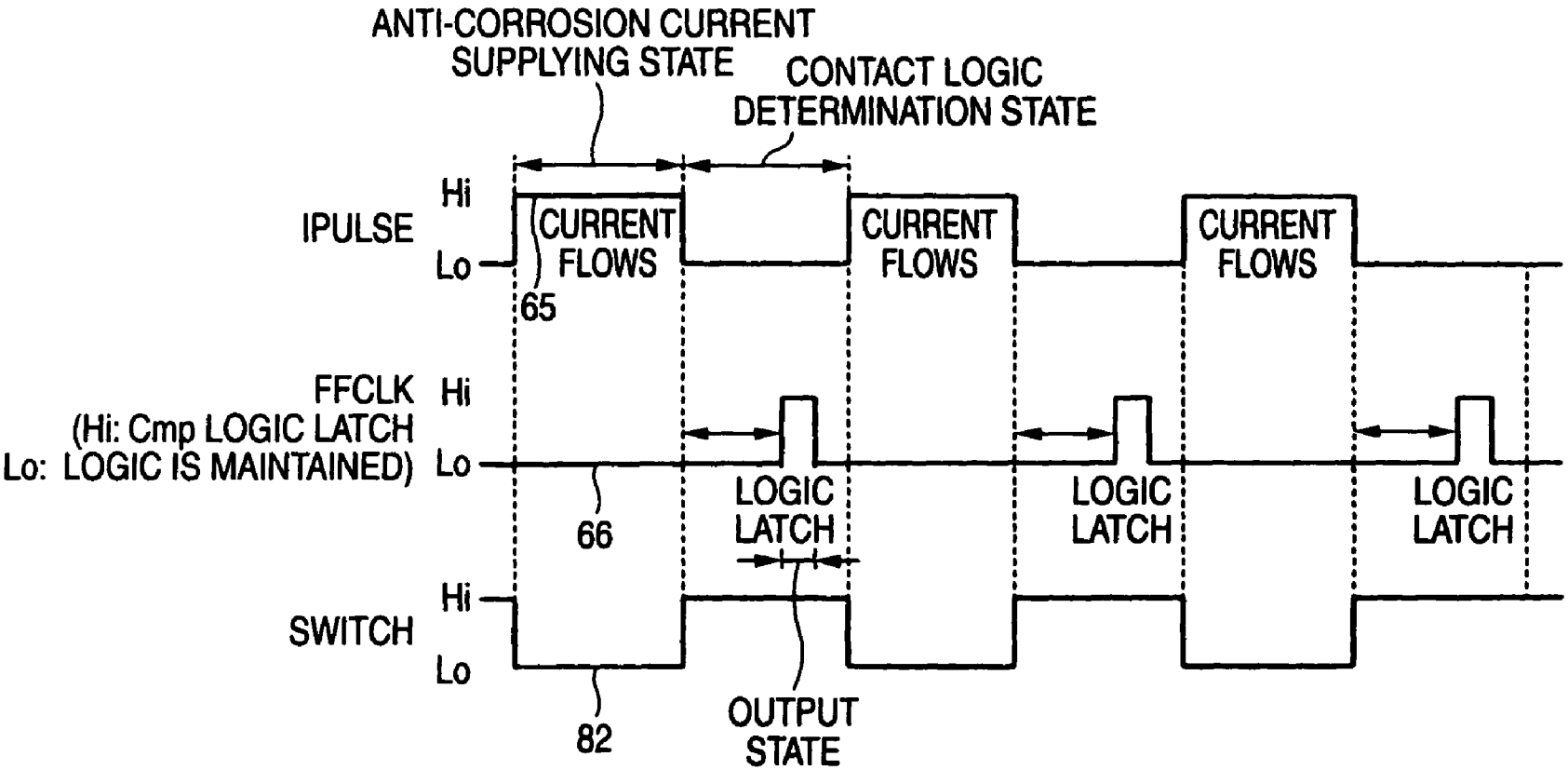
FIG. 9 is a timing chart illustrating a timing of a switch signal 82, a FFCLK signal 66, and an IPULSE signal 65 oscillated from an oscillating section 31D.

FIG. 9 is a timing chart illustrating timings of the IPULSE signal 65, the FFCLK signal 66, and the switching signal 82 oscillated from the oscillation section 31D. In FIG. 9, the abscissa represents an elapsed time, and the ordinate represents a high level Hi and a low level Lo. The switching signal 82 is an inverted signal of the IPULSE signal 65. The MPX 82 switches the connected conductive path 25 when the level of the switching signal 82 is changed from a low level Lo to a high level Hi. As a result, the conductive path 25 electrically connected to the contact logic determination section 30 is periodically switched. That is, the switching element 21 electrically connected to the contact logic determination section 30 can be periodically switched. Accordingly, it is possible to determine the logic state of the contact point 21*a* of each switching element 21 even when the integrated circuit 22D has a plurality of switching elements 21.

In the signal processing device 20D according to the present embodiment, the current supplying state switching section 29 included in each anti-corrosion circuit 64 switches between the anti-corrosion current supplying state and the contact logic determination state on the basis of the IPULSE signal 65 generated from the oscillation section 31D. Therefore, it is not necessary to provide the oscillation section 31D in every current supplying state switching section 29, so that the construction can be simplified.

In the signal processing device 20D according to the present embodiment, since a plurality of anti-corrosion circuits 64 share a single contact logic determination section 30, the number of components can be reduced when a plurality of anti-corrosion circuits 64 are provided in the integrated circuit 22D, so that the construction can be simplified.

Figure 10:
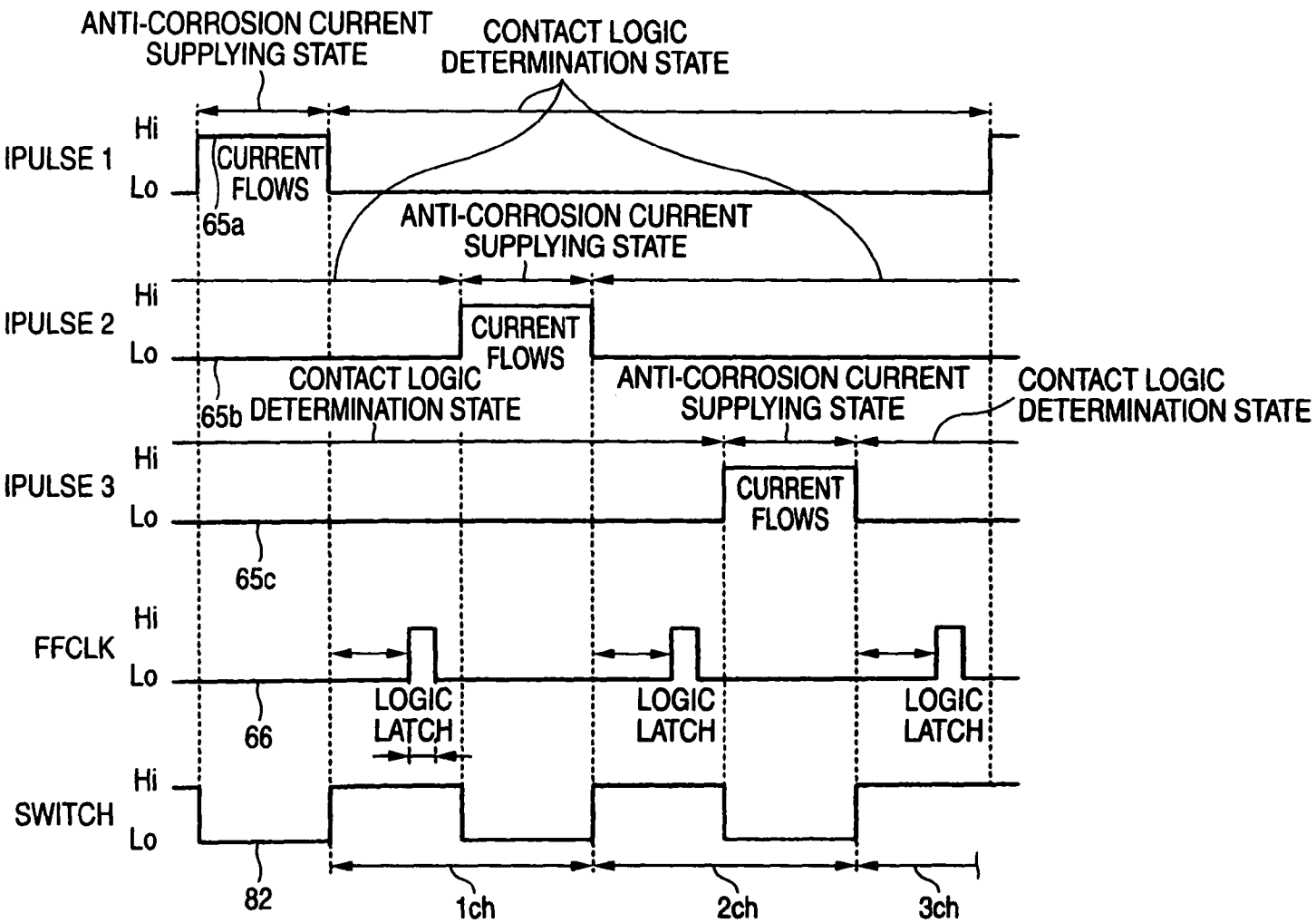
FIG. 10 is a timing chart illustrating a timing of an electric signal oscillated from an oscillating section 31D according to the second embodiment.

FIG. 10 is a timing chart illustrating a timing of an electric signal according to the second embodiment oscillated from the oscillation section 31D. In FIG. 10, the abscissa represents an elapsed time, and the ordinate represents a high level Hi and a low level Lo. The oscillation section 31D can oscillate three IPULSE signals 65*a*, 65*b*, and 65*c*, a FFCLK signal 66, and a switching signal 82. Although the present embodiment is described assuming that three IPULSE, signals are transmitted for a convenient description, the number of the IPULSE signals may be set to two or four or higher. The oscillation section 31D outputs three IPULSE signals 65*a*, 65*b*, and 65*c* to corrosion removal signal generating portions 52 of different anti-corrosion circuits 64. The three IPULSE signals 65*a*, 65*b*, and 65*c* periodically switches from a low level Lo to a high level Hi or from a high level Hi to a low level Lo at different timings. According to the present embodiment, the three IPULSE signals 65*a*, 66*b*, and 65*c* are triggered to a high level Hi at different timings and have a duty ratio of, for example, 17%. The switching signal 82 has a voltage level inverted against those of the three IPULSE signals 65*a*, 65*b*, and 65*c*. Specifically, when any one of the three IPULSE signals 65*a*, 65*b*, and 65*c* is triggered to a high level Hi, the switching signal 82 is triggered to a low level Lo.

In addition, when any one of the three IPULSE signals 65*a*, 65*b*, and 65*c* is triggered to a low level Lo, the switching signal 82 is triggered to a high level Hi. Therefore, the MPX 81 switches the connected conductive path 25 when any anti-corrosion circuit 64 switches from the anti-corrosion current supplying state to the contact logic determination state. It is possible to prevent the anti-corrosion current from being supplied to the contact logic determination section 30 by connecting this conductive path 25 to the conductive path 25 included in the anti-corrosion circuit 64 switching from the anti-corrosion current supplying state to the contact logic determination state.

In the signal processing device 20D according to the present embodiment, at least one current supplying state switching section 29 switches to the anti-corrosion current supplying state at a different timing from those of other current supplying state switching section 29. As a result, it is possible to prevent the anti-corrosion current from being simultaneously supplied to a plurality of anti-corrosion circuits 64, and it is possible to prevent a plurality of anti-corrosion circuits 64 from simultaneously generating heat and electromagnetic waves. Since at least one signal processing circuit out of a plurality of the anti-corrosion circuits 64 generates heat and electromagnetic waves at a different timing from those of other signal processing circuits, it is possible to prevent abnormal heating and avoid aggravation of an output electric field intensity.

In the signal processing device 20D according to the present embodiment, the current value of the anti-corrosion current can be changed on the basis of a detection result of a corrosion detection section. For example, when the corrosion in the contact point of the switching element has grown, the current value of the anti-corrosion current can be increased to promote removal of the corrosion. When the corrosion of the contact point has been removed, the current value of the anti-corrosion current can be reduced to avoid heat in the signal processing circuit.

The oscillation section 31 may be constructed of a CPU, or the duty ratio of the IPULSE signal 65 or the FFCLK signal 66 may be changed. For example, an input section may be provided to instruct the CPU so as to change the duty ratio.

Figure 11:
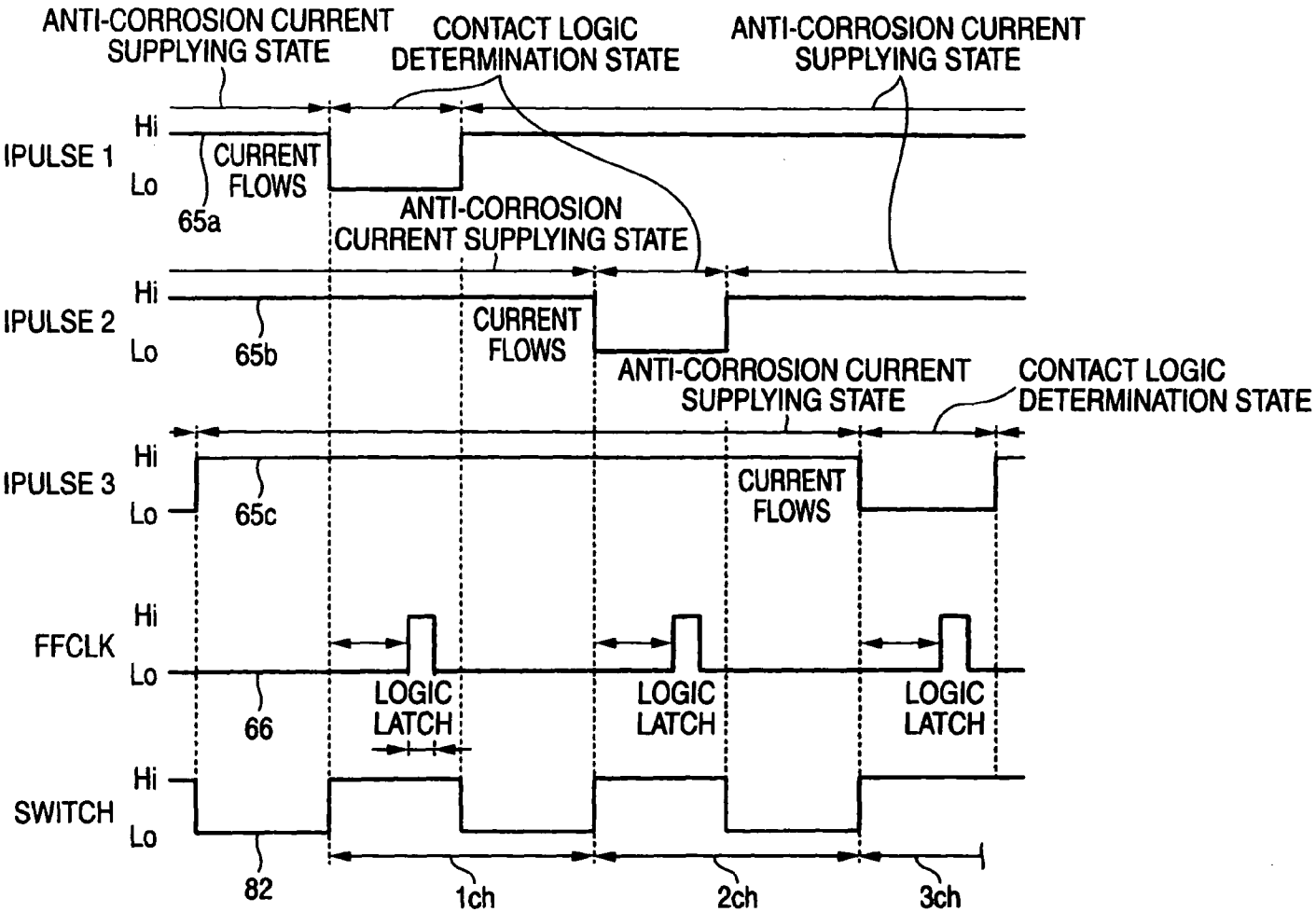
FIG. 11 is a timing chart illustrating a timing of an electric signal oscillated from an oscillating section 31D according to the third embodiment.

FIG. 11 is a timing chart illustrating a timing of an electric signal according to the third embodiment oscillated from the oscillating section 31D. In FIG. 11, the abscissa represents an elapsed time, and the ordinate represents a high level Hi and a low level Lo. As shown in FIG. 11, the three IPULSE signals 65*a*, 65*b*, and 65*c* have a duty ratio of 83% and are triggered to a low level Lo at different timings. The switching signal 82 is triggered to a high level Hi when any one of the three IPULSE signals 65*a*, 65*b*, and 65*c* is triggered to a low level Lo. In addition, switching signal 82 is triggered to a low level Lo when any one of the three IPULSE signals 65*a*, 65*b*, and 65*c* is triggered to a high level Hi. Since the MPX 81 connects the switching conductive path 25 to the conductive path 25 included in the anti-corrosion circuit 64 switching from the anti-corrosion current supplying state to the contact logic determination state, it is possible to prevent the anti-corrosion current from being supplied to the contact logic determination section 30 and to continuously supply the anti-corrosion current when the logic state of the contact point is not determined. Therefore, it is possible to efficiently supply the anti-corrosion current and determine the logic state of the contact point.

Although the determination result is output only in the contact logic determination state according to the present embodiment, a diagnostic detection may be performed even in the anti-corrosion current supplying state by detecting the voltage value of the conductive path 25 and detecting an earth fault or a short circuit on the basis of detected voltage value.

Although a plurality of anti-corrosion circuits 64 described in the first embodiment are provided according to the present embodiment, the integrated circuit may have a plurality of anti-corrosion circuits 64A, 64B, and 64C described in the second, third, or fourth embodiment.

Although the contact point of the switching element 21 is disposed in the low logic (Lo) side according to the present embodiment, it may be disposed in the high logic (Hi) side.

Figure 12:
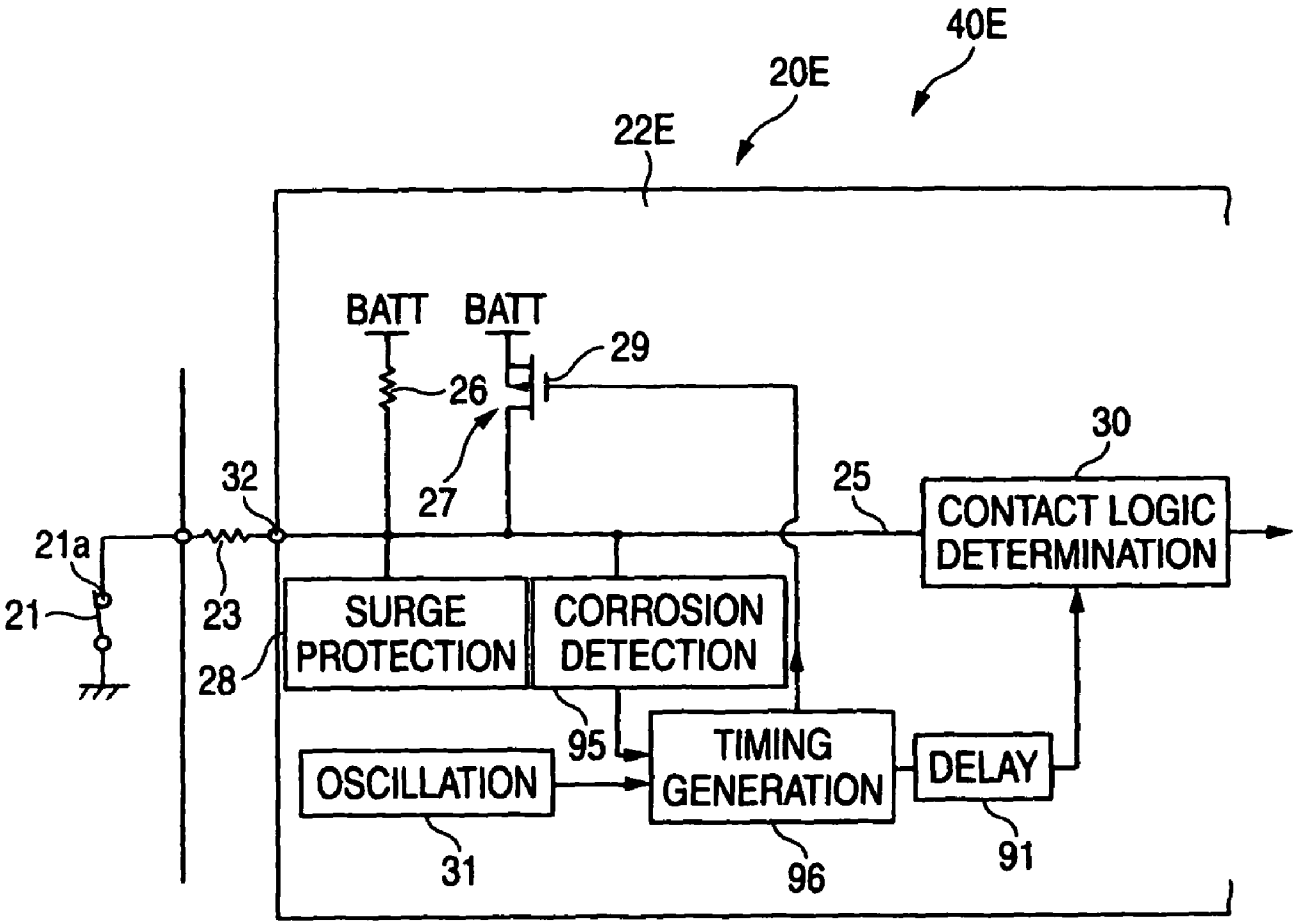
FIG. 12 is a circuit diagram schematically illustrating an electric circuit of a signal processing device 20E according to the sixth embodiment.

FIG. 12 is a circuit diagram schematically illustrating an electric circuit of a signal processing device 20E according to the sixth embodiment. The signal processing device E includes an integrated circuit 22E and is mounted on an ECU 40E. The signal processing device 20E according to the sixth embodiment includes a corrosion detection section 95 and a timing generating section 96 in addition to the components of the signal processing device 20 described in the first embodiment. The corrosion detection section 95 is electrically connected to the conductive path 25 and has a function of detection corrosion in the contact point 21*a* of the switching element 21. Specifically, the corrosion detection section 95 detects corrosion in the contact point 21*a* on the basis of the voltage applied to the conductive path 25. In addition, the corrosion detection section 95 is electrically connected to the timing generating section 96 and has a function of outputting an electrical signal to the timing generating section 96 when the corrosion is detected. The timing generating section 96 is constructed of an AND circuit and electrically connected to the oscillation section 31 and the current flowing state switching section 29. The timing generating section 96 outputs the corrosion removal signal to the current supplying state switching section 29 when it receives an electrical signal output from the corrosion detection section 95 and a high level (Hi) electrical signal output from the oscillation section 3. As a result, the current supplying state switching section 29 detects the corrosion in the contact point 21*a* of the switching element 21 and supplies the anti-corrosion current. As described above, the anti-corrosion current may be supplied while the corrosion in the contact point 21*a* of the switching element 21 is detected.

Figure 13:
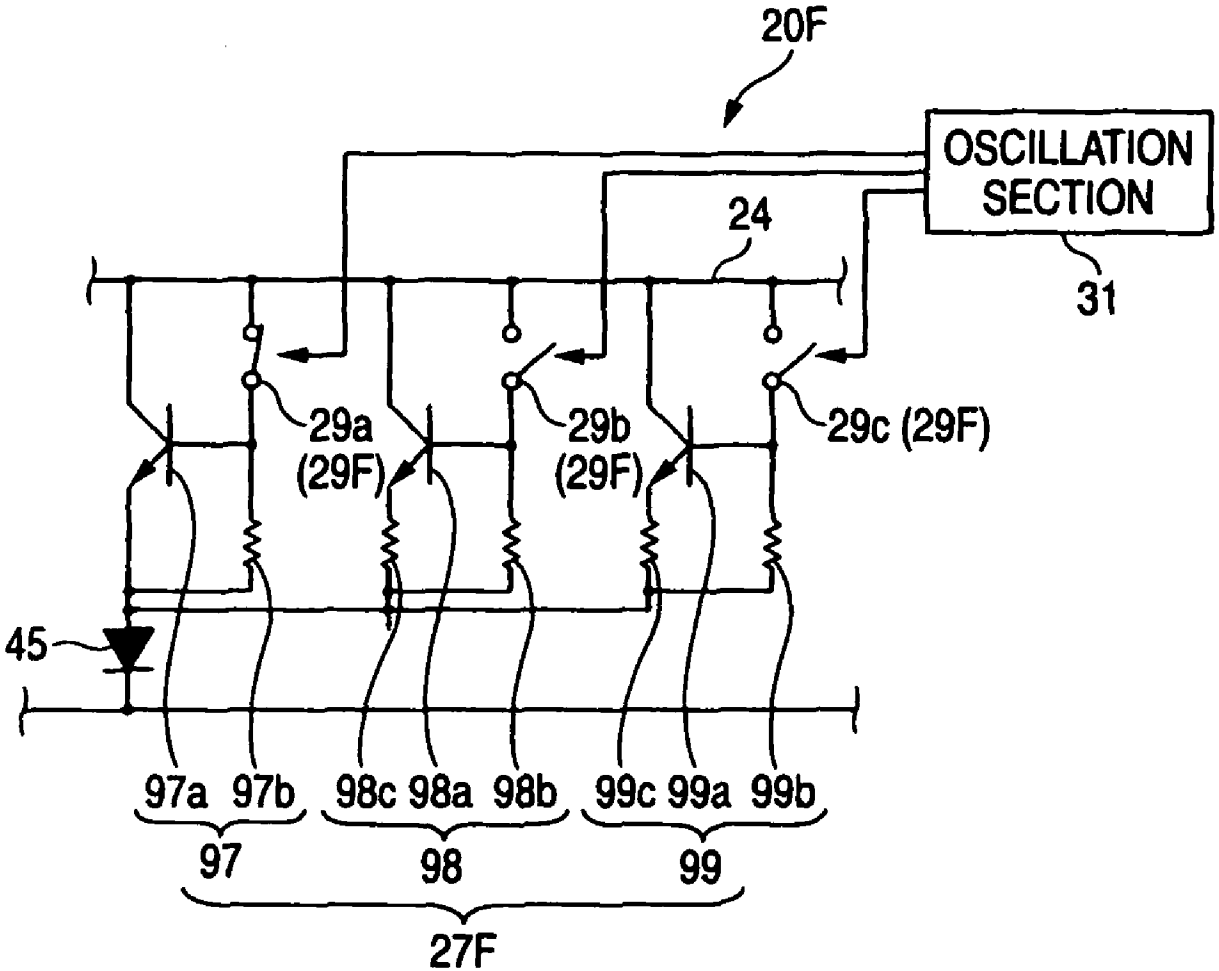
FIG. 13 is a circuit diagram schematically illustrating electric circuits of a current supplying state switching section 29F and an anti-corrosion current supplying section 27F included in a signal processing device 20F according to the seventh embodiment.

FIG. 13 is a circuit diagram schematically illustrating an electric circuit of a current supplying state switching section 29F and an anti-corrosion current supplying section 27F included in a signal processing device 20F according to the seventh embodiment. The anti-corrosion current supplying section 27 and the current supplying state switching section 29 included in the signal processing device 20F according to the seventh embodiment has constructions different from those of the signal processing device 20 described in the first embodiment. Therefore, only the anti-corrosion current supplying section 27 will be described in association with the signal processing device 20F. The anti-corrosion current supplying section 27F is a circuit for changing the current value of the anti-corrosion current flowing through the contact point 21*a* of the switching element 21. Specifically, the anti corrosion current supplying section 27F has a first current supplying section 97, a second current supplying section 98, and a third current supplying section 99.

The first current supplying section 97 has a function of supplying the anti corrosion current having a current value I1 to the contact point 21*a* of the switching element 21. The current value I1 is set to a value larger than the contact logic determination current. According to the present embodiment, the first current supplying section 97 includes an NPN type transistor 97*a* and a current restricting resistor 97*b*. The NPN type transistor 97*a* has an emitter and a base electrically connected to each other through the current restricting resistor 97*b*, in order to inhibit the anti-corrosion current when the logic state of the contact point is determined. In addition, the NPN type transistor 97*a* has a collector electrically connected to the power supply line 24 and an emitter electrically connected to the conductive path 25. However, the transistor type is not limited to the NPN type transistor, but may be a PNP type transistor.

A backward flow prevention section 45 is interposed between the emitter of the NPN type transistor 97*a* and the conductive path 25. According to the present embodiment, the backward flow prevention section 45 is a diode having an anode electrically connected to the first current supplying section 27F and a cathode electrically connected to the conductive path 25, so that the current flowing to the power supply line 24 is prevented when the voltage applied to the input terminal 32 increases.

The second current supplying section 98 has a function of supplying the anti-corrosion current having a current value I2 to the contact point 21*a* of the switching element 21. The current value I2 is set to a value smaller than the current value I1 and larger than the contact logic determination current. According to the present embodiment, the second current supplying section 98 includes an NPN type transistor 98*a*, a current restricting resistor 98*b*, and a resistor 98*c*. The NPN type transistor 98*a* has an emitter and a base electrically connected to each other through the current restricting resistor 98*b*, in order to inhibit the anti-corrosion current when the logic state of the contact point is determined. In addition, the NPN type transistor 98*a* has a collector electrically connected to the power supply line 24 and an emitter electrically connected to one end of the resistor 98*c*. The resistor 98*c* and the current restricting resistor 98*b* are connected in parallel. However, the transistor type is not limited to the NPN type transistor, but may be a PNP type transistor. The other end of the resistor 98*c* of the second current supplying section 98 is electrically connected to the conductive path 25 through the backward flow prevention section 45.

The third current supplying section 99 has a function of supplying the anti-corrosion current having a current value I3 to the contact point 21*a* of the switching element 21. The current value I3 is set to a value smaller than the current value I2 and larger than the contact logic determination current. According to the present embodiment, the third current supplying section 99 includes an NPN type transistor 99*a*, a current restricting resistor 99*b*, and a resistor 99*c*. The NPN type transistor 99*a* has an emitter and a base electrically connected to each other through the current restricting resistor 99*b*, in order to inhibit the anti-corrosion current when the logic state of the contact point is determined. In addition, the NPN type transistor 99*a* has a collector electrically connected to the power supply line 24 and an emitter electrically connected to one end of the resistor 99*c*. The resistor 99*c* and the current restricting resistor 99*b* are connected in parallel. However, the transistor type is not limited to the NPN type transistor, but may be a PNP type transistor. The other end of the resistor 99*c* is electrically connected to the conductive path 25 through the backward flow prevention section 45. The resistor 99*c* of the third current supplying section 99 has a resistance value larger than that of the resistor 98*c* of the second current supplying section 98.

The current supplying state switching section 29F is a circuit for switching between the anticorrosion current supplying state and the contact logic determination state as and changing the current value of the anti-corrosion current. The current supplying state switching section 29F includes a first switching section 29*a*, a second switching section 29*b*, and a third switching section 29*c*. The first, second, and third switching section 29*a*, 29*b*, and 29*c* are constructed of switches turned on or off in synchronization with the IPULSE signal transmitted from the oscillation section 31.

The first switching section 29*a* is electrically connected in series to the current restricting resistor 97*b* of the first current supplying section 97, and has one end electrically connected to the power supply line 24 and the other end electrically connected to the current restricting resistor 97*b*. The base of the NPN type transistor 97*a* of the first current supplying section 92 is connected to the first switching section 29*a* in parallel with the current restricting resistor 44.

The second switching section 29*b* is electrically connected to the current restricting resistor 98*b* of the second current supplying section 98 in series and has one end electrically connected to the power supply line 24 and the other end electrically connected to the current restricting resistor 98*b*. The base of the NPN type transistor 98*a* of the second current supplying section 98 is connected to the second switching section 29*b* in parallel with the current restricting resistor 99*b*.

The third switching section 29*c* is electrically connected to the current restricting resistor 99*b* of the third current supplying section 99 in series and has one end electrically connected to the power supply line 24 and the other electrically connected to the current restricting resistor 99*b*. The base of the NPN type transistor 99*a* of the third current supplying section 99 is connected to the third switching section 29*c* in parallel with the current restricting resistor 99*b*.

In addition, a microcomputer 92 is electrically connected to the oscillation section 31. The microcomputer 92 has a function of determining a corrosion growth condition of the contact point 21*a* of the switching element 21 on the basis of the determination result output from the contact logic determination section 30 and a function of selecting one of the first to third current supplying section 29*a* to 29*c* to which the anti-corrosion current should be transmitted from the oscillation section 31. Specifically, the microcomputer 92 has three predetermined critical values, and determines which of the critical values an output voltage value reaches. The corrosion growth condition of the contact point 21*a* of the switching element 21 is determined on the bass of the number of critical values that the output voltage value reaches, and one of the first to third current supplying section 29*a* to 29*c* to which the anti-corrosion current should be transmitted from the oscillation section 31 is selected. Then, the anti-corrosion current is transmitted to the selected one of the first to third current supplying section 29*a* to 29*c*.

Now, operations of the anti-corrosion current supplying section 27 and the current supplying state switching section 29 having the above construction will be described. In a first condition where the microcomputer 92 determines that the corrosion has significantly grown, the corrosion removal signal is transmitted from the oscillation section 31 to the first switching section 29*a*. On the basis of this signal, the first switching section 29*a* connects the power supply line 24 to the current restricting resistor 97*b*. As a result, the current path between the collector and the emitter of the NPN type transistor 97*a* is connected, and the anti-corrosion current having a current value I1 flows to the contact point 21*a* of the switching element 21.

When the microcomputer 92 determines that the corrosion growth is less than the first condition, the corrosion removal signal is transmitted from the oscillation section 31 to the second switching section 29*b*. On the basis of this signal, the second switching section 29*b* connects the power supply line 24 to the current restricting resistor 98*b*. As a result, the current path between the collector and the emitter of the NPN type transistor 98*a* is connected, and the anti-corrosion current having a current value I2 flows to the contact point 21*a* of the switching element 21.

When the microcomputer 92 determines that the corrosion growth is less than the second condition, the corrosion removal signal is transmitted from the oscillation section 31 to the second switching section 29*c*. On the basis of this signal, the third switching section 29*c* connects the power supply line 24 to the current restricting resistor 99*b*. As a result, the current path between the collector and the emitter of the NPN type transistor 99*a* is connected, and the anti-corrosion current having a current value I3 flows to the contact point 21*a* of the switching element 21.

As described above, the microcomputer 92 detects the corrosion growth condition of the contact point 21*a* of the switching element 21 on the basis of the determination result, and determines the current value of the anti-corrosion current supplied to the contact point 21*a* of the switching element 21 on the basis of the corrosion growth condition.

In the signal processing device 20F according to the present embodiment, a current supplying section to which the anti-corrosion signal should be transmitted from the oscillation section 31 is selected from first to third current supplying section 29*a* to 29*c*. Therefore, three different current values I1, I2, and I3 can be used for the anti-corrosion current.

In the signal processing device 20F according to the present embodiment, it is possible to change the current value of the anti-corrosion current on the basis of the determination result of the contact logic determination section 30. For example, when it is determined that the corrosion in the contact point 21*a* of the switching element 21 significantly grows, the current value of the anti-corrosion current can be set to a higher value in order to promote the removal of the corrosion. When it is determined that there is no corrosion in the contact point 21*a* of the switching element 21, the current value of the anti-corrosion current can be set to a lower value in order to reduce the heat generated in the signal processing circuit.

What is claimed is:

1. A method for preventing corrosion of a contact point comprising:

supplying an anti-corrosion current to the contact point through a input terminal of a signal processing circuit electrically connected to the contact point and a series resistor electrically interposed between the contact point and the input terminal so as to remove corrosion of the contact point; and reducing a surge input to the signal processing circuit by the series resistor.

2. A signal processing circuit having an input terminal electrically connected to a contact point, the signal processing circuit comprising:

an anti-corrosion current supplying section operable to supply an anti-corrosion current to the contact point through the input terminal so as to remove corrosion in the contact point;

a current supplying state switching section operable to switch between a current supplying state and a current non-supplying state of the anti-corrosion current in the anti-corrosion current supplying section; and a timing signal generating section operable to generate a timing signal which periodically changes and output the generated timing signal to the current supplying state switching section, wherein the current supplying state switching section switches between the current supplying state and the current non-supplying state of the anti-corrosion current in the anti-corrosion current supplying section based on a change of the timing signal.

3. A signal processing device electrically connected to a contact point comprising:

a signal processing circuit including:

an input terminal electrically connected to the contact point; and an anti-corrosion current supplying section operable to supply an anti-corrosion current to the contact point through the input terminal so as to remove corrosion in the contact point; and a series resistor electrically interposed between the input terminal and the contact point, wherein:

the anti-corrosion current is supplied to the contact point through the series resistor.

4. The signal processing device as set forth in claim 1, wherein the series resistor reduces a surge input from the contact point to the signal processing circuit.

5. The signal processing device as set forth in claim 1, further comprising:

a current supplying state switching section operable to switch a current supplying state of the anti-corrosion current supplied by the anti-corrosion current supplying section;

a timing signal generating section operable to generate a timing signal which periodically changes and output the generated timing signal to the current supplying state switching section;

wherein the current supplying state switching section switches the current supplying state of the anti-corrosion current based on a change of the output timing signal.

6. The signal processing device as set forth in claim 5, wherein:

a plurality of the signal processing circuits are provided in the signal processing device;

the generated timing signal is output to each of the current supplying state switching sections of the signal processing circuits; and each of the current supplying state switching sections switches the current supplying state of the anti-corrosion current based on a change of the output timing signal.

7. The signal processing device as set forth in claim 6, wherein:

the timing signal includes a first timing signal and a second timing signal having a timing different from a timing of the first timing signal;

the first timing signal is output to one of the current supplying state switching sections; and the second timing signal is output to the other one of the current supplying state switching sections.

8. The signal processing device as set forth in claim 1, wherein the signal processing circuit further comprises:

a contact logic determination current supplying section operable to supply a contact logic determination current having a current value smaller than a current value of the anti-corrosion current to the input terminal;

a contact logic determination section electrically connected to the input terminal and operable to determine a connection state of the contact point based on a voltage applied to the input terminal; and a current supplying state switching section operable to switch between an anti-corrosion current supplying state in which the anti-corrosion current is supplied to the input terminal and a contact logic determination state in which the contact logic determination current is supplied to the input terminal and the connection state of the contact point is determined.

9. The signal processing device as set forth in claim 8, further comprising:

a timing signal generating section operable to generate a timing signal which periodically changes and output the generated timing signal to the current supplying state switching section, wherein the current supplying state switching section switches between the anti-corrosion current supplying state and the contact logic determination state based on a change of the output timing signal.

10. The signal processing device as set forth in claim 9, wherein the contact logic determination section is operable to output a determination result of the connection state of the contact point in the contact logic determination state based on the change of the timing signal.

11. The signal processing device as set forth in claim 8, wherein the contact logic determination section includes a voltage reduction unit operable to reduce a voltage applied to the contact logic determination section when the anti-corrosion current is supplied through the input terminal.

12. The signal processing device as set forth in claim 8, wherein the anti-corrosion current supplying section changes the current value of the anti-corrosion current based on a determination result of the connection state of the contact point.

13. The signal processing device as set forth in claim 8, further comprising a spark absorption section that absorbs sparks generated when the current supplying state switching section switches between the contact logic determination state and the anti-corrosion current supplying state.

14. A control unit operable to control a driving device, comprising:

the signal processing device as set forth in claim 8; and a control section, wherein the control section operable to control the driving device based on the connection state of the contact point.

* * * * *